US009179750B2

(12) United States Patent
Bernhard

(10) Patent No.: US 9,179,750 B2
(45) Date of Patent: Nov. 10, 2015

(54) COMBINATION BEVERAGE AND SANDWICH CONTAINER

(71) Applicant: Jordan CreativeWorks, LLC, Los Angeles, CA (US)

(72) Inventor: Jordan S. Bernhard, Los Angeles, CA (US)

(73) Assignee: Jordan Creativeworks, LLC, Santa Monica, CA (US)

( * ) Notice: Subject to any disclaimer, the term of this patent is extended or adjusted under 35 U.S.C. 154(b) by 0 days.

(21) Appl. No.: 13/790,053

(22) Filed: Mar. 8, 2013

(65) Prior Publication Data

US 2013/0292274 A1 Nov. 7, 2013

Related U.S. Application Data

(60) Provisional application No. 61/643,441, filed on May 7, 2012.

(51) Int. Cl.

| | |
|---|---|
| ***B65D 77/00*** | (2006.01) |
| ***A45C 11/20*** | (2006.01) |
| ***B65D 85/72*** | (2006.01) |
| ***B65D 25/00*** | (2006.01) |
| ***B65D 81/00*** | (2006.01) |
| ***B65D 5/42*** | (2006.01) |
| ***B65D 25/04*** | (2006.01) |
| ***B65D 81/32*** | (2006.01) |
| ***B65D 51/28*** | (2006.01) |

(52) U.S. Cl.

CPC . *A45C 11/20* (2013.01); *B65D 5/42* (2013.01); *B65D 25/00* (2013.01); *B65D 25/04* (2013.01); *B65D 51/28* (2013.01); *B65D 81/00* (2013.01); *B65D 81/3211* (2013.01); *B65D 85/72* (2013.01); *B65D 2517/0044* (2013.01)

(58) Field of Classification Search

CPC ..... A45C 11/20; B65D 5/72; B65D 5/42; B65D 85/72; B65D 25/04; B65D 25/00; B65D 2217/04; B65D 81/3211; B65D 2517/0044

USPC ..... 206/217, 229, 548; 215/6, 380; 229/115, 103.1, 400; 220/722, 710, 220/723; 426/120, 115, 106

See application file for complete search history.

(56) References Cited

U.S. PATENT DOCUMENTS

| | | | | |
|---|---|---|---|---|
| 674,989 | A | 5/1901 | Ritz | |
| 1,514,379 | A | 11/1924 | Fleischer | |
| 2,241,834 | A | 5/1941 | Wentz | |
| 2,287,610 | A | 6/1942 | Guidry | |
| 2,424,536 | A | 7/1947 | Mayer et al. | |
| 2,503,045 | A | 4/1950 | Hamilton | |
| 2,740,575 | A * | 4/1956 | Fontaine | 229/103.1 |

(Continued)

OTHER PUBLICATIONS

Spinner, Jenni, "Budweiser toasts open-end cans in Asia," Oct. 9, 2012, Packaging Digest, downloaded on Oct. 23, 2012.

(Continued)

*Primary Examiner* — Anthony Stashick
*Assistant Examiner* — James M Van Buskirk
(74) *Attorney, Agent, or Firm* — K&L Gates LLP

(57) ABSTRACT

Combination beverage and food containers. Various embodiments are configured to store a consumable beverage or otherwise consumable liquid as well as at least one second item which may comprise an edible foodstuff, such as for example, sandwich wedges, bagels, donuts, etc.

14 Claims, 17 Drawing Sheets

(56) References Cited

U.S. PATENT DOCUMENTS

| | | | | | |
|---|---|---|---|---|---|
| 3,081,926 | A | | 3/1963 | Newton | |
| 3,288,344 | A | | 11/1966 | Woolen et al. | |
| 3,302,817 | A | | 2/1967 | Rollins et al. | |
| D216,949 | S | | 3/1970 | Maben | |
| 3,931,891 | A | | 1/1976 | Peppler | |
| 4,065,536 | A | | 12/1977 | Lucas | |
| 4,135,512 | A | | 1/1979 | Godsey | |
| 4,279,349 | A | | 7/1981 | Aigner | |
| 4,292,846 | A | * | 10/1981 | Barnett | 73/427 |
| 4,911,320 | A | | 3/1990 | Howes | |
| 4,919,295 | A | | 4/1990 | Hitzler | |
| 5,054,642 | A | | 10/1991 | Yoshida | |
| 5,065,875 | A | | 11/1991 | Balavich | |
| 5,241,835 | A | * | 9/1993 | Ascone | 62/372 |
| 5,290,574 | A | | 3/1994 | Jamieson et al. | |
| 5,332,112 | A | | 7/1994 | Blocker | |
| 5,335,813 | A | * | 8/1994 | Qi | 220/524 |
| 5,392,947 | A | * | 2/1995 | Gentile | 220/665 |
| 5,417,364 | A | | 5/1995 | Shaw | |
| 5,447,245 | A | | 9/1995 | Merhar | |
| 5,492,244 | A | | 2/1996 | Kim | |
| D370,412 | S | | 6/1996 | Rohrer | |
| 5,540,333 | A | | 7/1996 | Gonzalez et al. | |
| D376,311 | S | | 12/1996 | Burton | |
| 5,674,391 | A | * | 10/1997 | Nohren, Jr. | 210/266 |
| 5,722,558 | A | | 3/1998 | Thompson | |
| 5,881,868 | A | | 3/1999 | Soyak et al. | |
| 5,992,677 | A | | 11/1999 | Ebine | |
| 6,006,945 | A | | 12/1999 | Kirkland | |
| 6,053,401 | A | * | 4/2000 | Andrews, Sr. | 229/117.3 |
| 6,053,402 | A | | 4/2000 | Thomas et al. | |
| 6,079,586 | A | * | 6/2000 | Hanneman | 220/526 |
| D427,427 | S | | 7/2000 | Davis | |
| 6,419,081 | B1 | | 7/2002 | Ross | |
| 6,488,146 | B1 | | 12/2002 | Dotsikas | |
| 6,502,713 | B1 | | 1/2003 | Baker | |
| 6,706,297 | B1 | * | 3/2004 | Toth et al. | 426/120 |
| D499,651 | S | | 12/2004 | Gong | |
| 6,932,231 | B2 | | 8/2005 | Haynes et al. | |
| 7,143,930 | B2 | * | 12/2006 | Money et al. | 229/115 |
| 7,500,579 | B2 | | 3/2009 | Crossley | |
| 7,665,631 | B2 | | 2/2010 | Pikowski | |
| 2009/0108004 | A1 | | 4/2009 | Bollengier | |
| 2013/0292293 | A1 | | 11/2013 | Bernhard | |
| 2013/0295237 | A1 | | 11/2013 | Bernhard | |
| 2013/0295239 | A1 | | 11/2013 | Bernhard | |

OTHER PUBLICATIONS

Coke® Can Fridge, created .pdf document on Jun. 26, 2012.
Four Photographs of Liquid PLUMR plastic container, photographed and created a .jpg on Feb. 5, 2013.
Printout containing four container advertisements, obtained at least as early as Dec. 6, 2008.
U.S. Appl. No. 13/790,038, filed Mar. 8, 2013.
U.S. Appl. No. 13/790,067, filed Mar. 8, 2013.
U.S. Appl. No. 13/790,077, filed Mar. 8, 2013.
Official Action for U.S. Appl. No. 13/790,038, dated Aug. 14, 2014.
Applicant-Initiated interview Summary for U.S. Appl. No. 13/790,038, dated Sep. 17, 2014.
Amendment for U.S. Appl. No. 13/790,038, dated Oct. 24, 2014.
Restriction Requirement for U.S. Appl. No. 13/790,067, dated Sep. 12, 2014.
Restriction Requirement for U.S. Appl. No. 13/790,077, dated Sep. 10, 2014.
Official Action for U.S. Appl. No. 13/790,038, dated Feb. 13, 2015.
Amendment After Final Official Action for U.S. Appl. No. 13/790,038, dated Mar. 9, 2015.
Advisory Action for U.S. Appl. No. 13/790,038, dated Mar. 24, 2015.
Amendment Accompanying Request for Continued Examination for U.S. Appl. No. 13/790,038, dated Mar. 30, 2015.
Amendment for U.S. Appl. No. 13/790,067, dated Oct. 28, 2014.
Amendment for U.S. Appl. No. 13/790,077, dated Oct. 28, 2014.
Official Action for U.S. Appl. No. 13/790,077, dated Sep. 8, 2015.
Official Action for U.S. Appl. No. 13/790,038, dated Apr. 23, 2015.
Amendment for U.S. Appl. No. 13/790,038, dated May 12, 2015.
Official Action for U.S. Appl. No. 13/790,067, dated Jul. 27, 2015.
Amendment for U.S. Appl. No. 13/790,067, dated Aug. 27, 2015.

* cited by examiner

10''
14
12
16
34
9

8
21
28
26
20
32

F
L
13
24
30

COMBINATION BEVERAGE AND SANDWICH CONTAINER

CROSS REFERENCE TO RELATED APPLICATIONS

This non-provisional patent application claims the benefit of and priority under 35 U.S.C. §119(e) from U.S. Provisional Patent Application Ser. No. 61/643,441, filed May 7, 2012, the entire disclosure of which is herein incorporated by reference.

FIELD OF THE INVENTION

The present invention relates to beverage and storage vessels and more particularly, to a combination beverage container and storage vessel constructible into a variety of shapes and sizes having various geometric configurations or surface profiles.

BACKGROUND

People often rely on prepackaged foods for a meal or snack, but eating them sometimes takes considerable effort, especially when multiple food containers are involved. One example is the triangular sandwich container that holds a pair of wedge-shaped sandwich halves behind a hermetic seal; another is a flimsy disposable plastic cup containing foodstuff like pasta salad requiring use of a utensil; third is a bag of chips, etc.; fourth is the common pull-tab aluminum beer can, and fifth is the most common example: a paper beverage (soda) cup with plastic lid and a straw—all which create large quantities of trash. Usually, you must place one container down in order to manipulate the other or its contents, or when the proximity of your neighbors hampers free movement and you can only squeeze food into your mouth. Other times, only a small amount of liquid and edible product is desired to satisfy one's cravings, as is often the case with children, but circumstances or venue often result in very expensive or super-sized options. None in today's marketplace, however, offers a balanced amount of food and drink in an affordable, single-piece disposable apparatus.

Hence, there is a need for a new and novel combination beverage container and storage vessel that holds both a pre-filled consumable liquid whether hot or cold, and, separately, a second product, presumably, but not limited to, foodstuff whether hot or cold or a non-edible item such as a toy or novelty, packaged together in a way which can be held in one hand and be easy to manipulate.

There is also a need for a combination beverage container and storage vessel which has balanced or proportional measures of consumable product in separate chambers or compartments, regardless of whether they are sealed.

There is also a need for a combination beverage container and storage vessel that is relatively easy and inexpensive to manufacture.

There is a further need for a combination beverage container and storage vessel that can be manufactured from a variety of different materials into various shapes and sizes.

There is a subsequent need for a combination beverage container and storage vessel that can incorporate variety of openable mouth holes or spouts protected by all kinds of hermetic seals to include peel-off or punch-through materials like foil, metals, perforations, paper, plastics, pop-tops, pull and fold tabs, twist-off caps, threaded nipple and screw cap (commonly referred to as the "re-closable spout"), a swivelable or rotatable closure assembly, a push/pull spout or a folding spout, possibly with a protrusion (such as for mounting of a pull-ring assembly) or without any protrusion (such as for typical foil seal closures).

There is another need for a combination beverage container and storage vessel whose design stimulates mass appeal.

There is also a need for a combination beverage container and storage vessel whose configuration(s) reduce waste.

Another need exists for a combination beverage and storage container that may hold relatively large amounts of beverage and foodstuffs or other items that is not necessarily capable of being hand-held.

The world is full of variants of food carriers and bottles and cans, and manufacturers have been known to affix separate packages onto these containers, such as promotional materials, prize tickets or tests of new flavors of consumables like beer nuts or gum. Further, many examples exist of single-piece or un-openable containers which utilize a double-wall construction technique, usually surrounding an external cavity, whose sole purpose is to benefit from the resulting thermophysical properties of the double wall construction techniques that diminish premature dissipation of a substance's (usually a consumable beverage) temperature residing within said external cavity. Others prefill this void with a non-edible substance for added insulation, again intended to reap the same or greater benefit.

Various embodiments disclosed herein may address one or more of the needs identified above and others. The foregoing discussion is intended only to illustrate some of the shortcomings present in the field of the invention at the time, and should not be taken as a disavowal of claim scope.

BRIEF DESCRIPTION OF THE FIGURES

The accompanying drawings, which are incorporated in and constitute a part of this specification, illustrate embodiments, and, together with the general description given above, and the detailed description given below, serve to explain the principles of the various forms and embodiments disclosed herein.

Corresponding reference characters indicate corresponding parts throughout the several views. The exemplifications set out herein illustrate various embodiments, in one form, and such exemplifications are not to be construed as limiting the scope of the invention in any manner.

DETAILED DESCRIPTION

Figure 3:
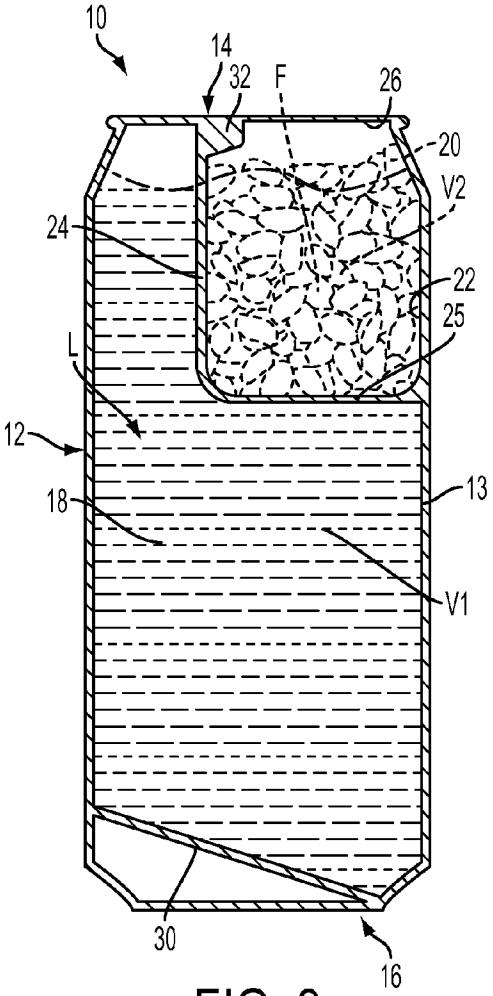
FIG. 3 is a cross-sectional elevational view of the combination beverage and storage vessel embodiment of FIGS. 1 and 2 taken along line 3-3 in FIG. 2.

Applicant of the present application also owns the following patent applications that were filed on even date herewith and which are each herein incorporated by reference in their respective entireties:

U.S. Patent Application entitled "Combination Beverage and Storage Container";

U.S. Patent Application entitled "Combination Beverage Cup With Removable Storage Container"; and U.S. Patent Application entitled "Box-Shaped Combination Beverage and Storage Container With Movable Closure".

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments is defined solely by the claims. The features illustrated or described in connection with one exemplary embodiment may be combined with the features of other embodiments. Such modifications and variations are intended to be included within the scope of the present invention.

FIGS. 1-4 illustrate one exemplary combination beverage container and storage vessel 10. In at least one embodiment, the vessel 10 may comprise a can that may be fabricated from a variety of consumer-safe metals such as aluminum, steel, etc. In other embodiments, however, the storage vessel 10 may be fabricated from various consumer-safe polymer materials such as fibrous materials, polymer materials, ceramic materials, cardboard, coated cardboard, etc. that are compatible with the types of liquids and/or foodstuffs to be contained therein. The storage vessel 10 as shown comprises a hand-held body portion 12, a non-removable top end portion 14 and a bottom end or portion 16. As used herein, the term "hand-held" means that the storage vessel may be entirely supported and/or manipulated by one hand. In other embodiments, the body may not be hand-held. However, in at least one embodiment, for example, the storage vessel 10 resembles a conventional beverage can that may be, if desired, dispensed by conventional dispensing machines and apparatuses employed, for example, by the soda pop, beer and beverage industries. The top end wall 14 may be integrally formed with the body 12 or it may comprise a separate member that is otherwise non-removably attached to the body 12 (e.g., by crimping, adhesive, solder, etc.) such that a hermetic or fluid-tight seal is formed therebetween. For example, the top end wall 14 may be attached to the body 12 using conventional attachment methods that are employed in the manufacture of conventional beer and soda cans.

Figure 2:
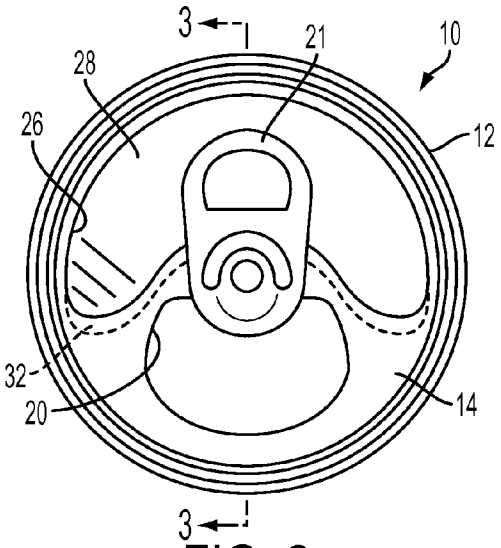
FIG. 2 is a top view of the combination beverage and storage vessel embodiment of FIG. 1.
Figure 4:
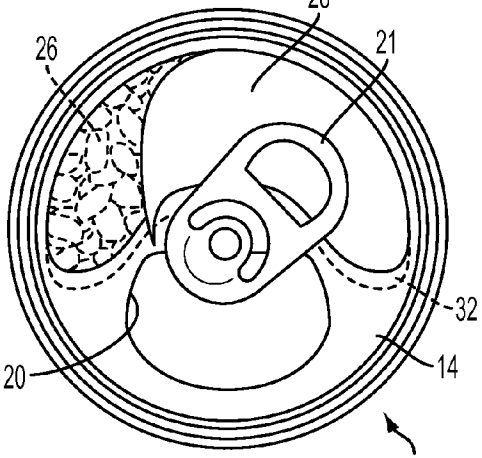
FIG. 4 is another top view of the combination beverage and storage vessel embodiment of FIGS. 1-3 with the second seal covering the access opening into the second storage area being partially peeled back.
Figure 1:
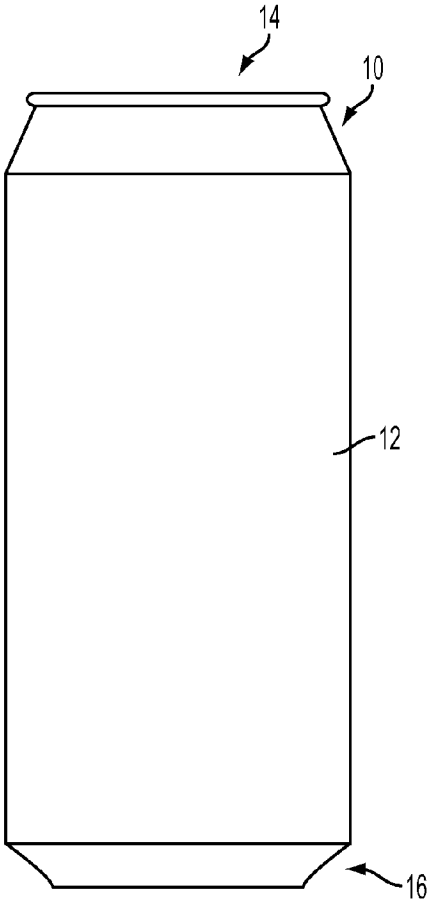
FIG. 1 is an elevational view of a combination beverage and storage vessel embodiment that defines two separate storage areas that may be employed to contain two separate mediums such as, for example, a beverage and a foodstuff.
Figure 3A:
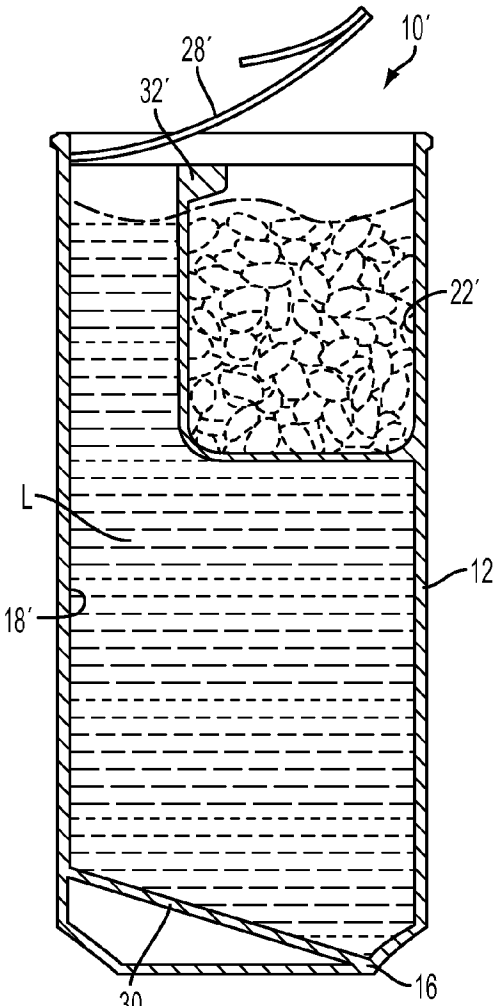
FIG. 3A is a cross-sectional elevational view of the combination beverage and storage vessel embodiment of FIGS. 1A and 2A after the outer seal has been removed.
Figure 2A:
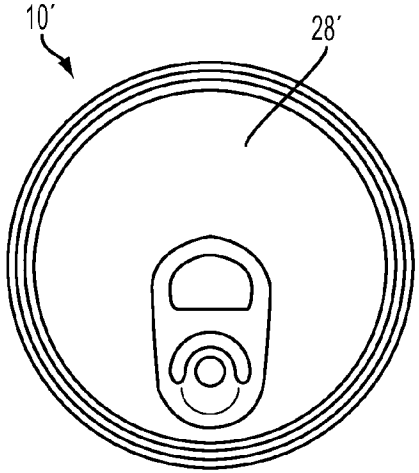
FIG. 2A is a top view of the combination beverage and storage vessel embodiment of FIG. 1A.
Figure 4A:
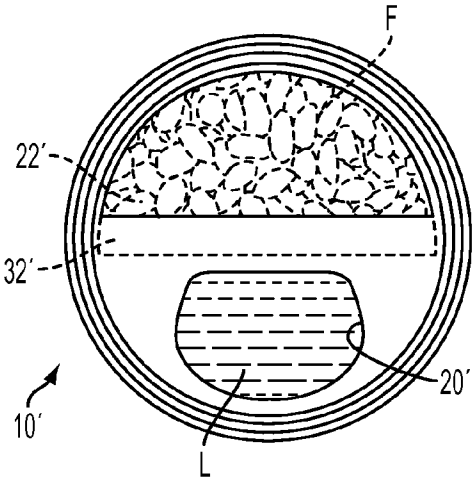
FIG. 4A is another top view of the combination beverage and storage vessel embodiment of FIGS. 1A, 2A, 3A, and 3B with the second seal completely removed.
Figure 1A:
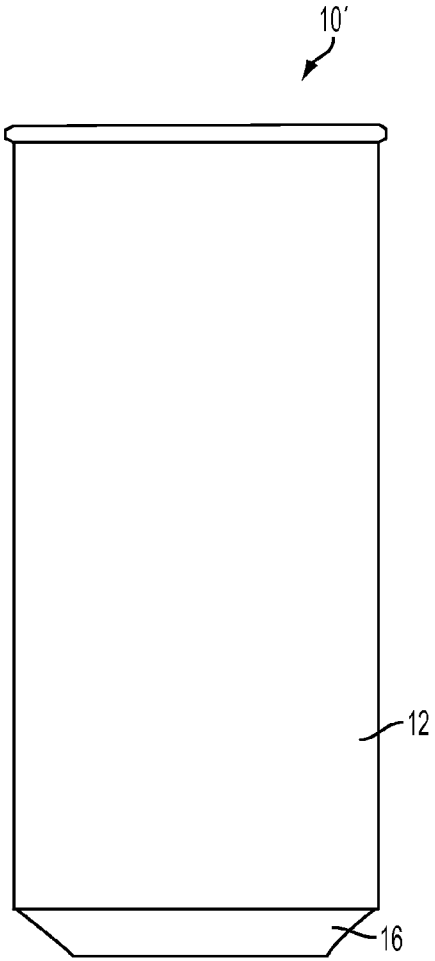
FIG. 1A is an elevational view of another combination beverage and storage vessel embodiment of the present invention.
Figures 5, 6, 7, 8, 9:
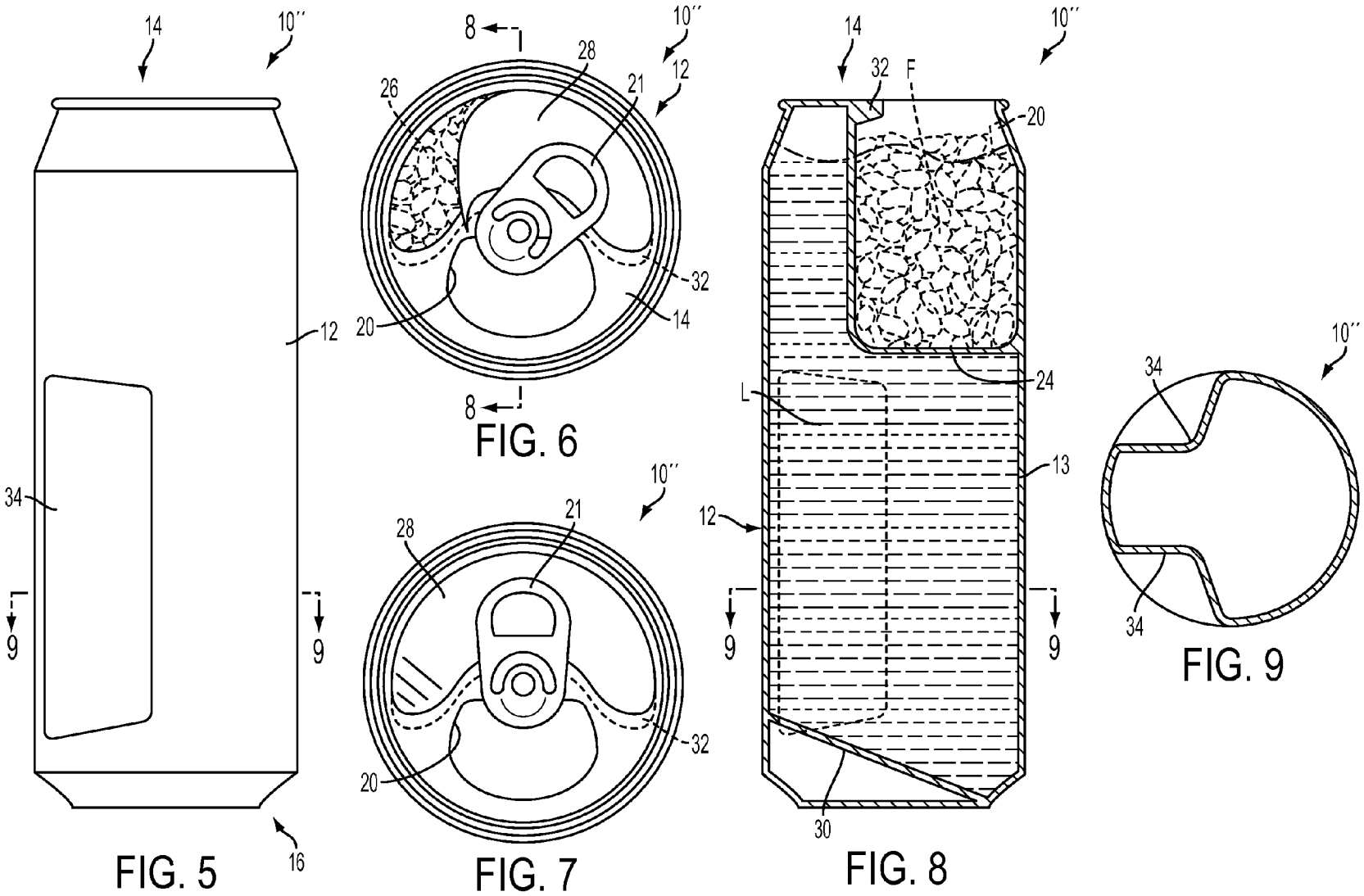
FIG. 5 is an elevational view of another combination beverage and storage vessel embodiment that defines two separate storage areas that may be employed to contain two separate mediums such as, for example, a beverage and a foodstuff.
FIG. 6 is a top view of the combination beverage and storage vessel embodiment of FIG. 5 with the second seal covering the access opening into the second storage area being partially peeled back.
FIG. 7 is a top view of the combination beverage and storage vessel embodiment of FIGS. 5 and 6.
FIG. 8 is a cross-sectional elevational view of the combination beverage and storage vessel embodiment of FIGS. 5-7 taken along line 8-8 in FIG. 6.
FIG. 9 illustrates a cross-sectional shape of the body portion of the combination beverage and storage vessel of FIGS. 5-8 taken along line 9-9 in FIGS. 5 and 8.

In at least one form, the body 12 defines a first storage area 18. As can be seen in FIGS. 2 and 4, the first storage area 18 may be accessible through a first access opening 20 formed in the top end wall 14. In the illustrated embodiment, the first access opening 20 is hermetically sealed by a first seal member in the form of a conventional pull tab arrangement 21 that is manufactured using conventional manufacturing techniques. Other forms of removable seals may be employed in alternative embodiments. For example, the first seal may comprise a piece of removable tape or foil. In other embodiments, the first seal may comprise a membrane that is permanently affixed over the first access opening, but which may be readily punctured by, for example, a straw, etc. to gain access to the consumable liquid L contained within the first storage area.

As can be most particularly seen in FIG. 3, the storage vessel 10 further includes a "second" storage area 22 that is integrally formed or defined by a first vertical wall portion 24 and first bottom wall portion 25 within the body 12 that extends from the top end wall 14 to a sidewall 13 of the body 12. In the illustrated embodiment, the first wall member 24 is integrally formed with the sidewall 13 and, in those embodiments wherein the top end wall 14 is integrally formed with the sidewall 13, the first wall member 24 may also be integrally formed with the top end wall 14. In other embodiments, for example, wherein the top end wall 14 is crimped or otherwise attached to the body 12, the first wall member 24 may be integrally formed with the sidewall 13 to define the second storage area 22 therewithin that is covered by a portion of the top end wall 14. In still other embodiments, the first wall member 24 may comprise a separate wall component that is attached to the sidewall 13 and/or the top end wall 14 by an appropriate fastening means (e.g., adhesive, solder, crimping, etc.). As can be seen in FIG. 4, a second access opening 26 is provided through the top end wall 14 to provide access into the second storage area 22. The second access opening 26 may be hermetically sealed with a second seal member 28, such as a "peel-back" foil seal or other suitable means. In other applications, the second seal member 28 may be omitted.

In the illustrated embodiment, the first storage area 18 has a first storage volume V1 and the second storage area 22 has a second storage volume V2 that is smaller than the first storage volume V1. Such storage arrangements are particularly well-suited for holding a pre-filled consumable liquid L, such as, for example, beer, soda, fruit juice, sports drink, etc. in the first storage area 18 and at least one second item such as edible materials like foodstuff F (peanuts, etc.) or other non-consumables (toys, novelties, etc.) in the second storage area 22. In alternative embodiments, however, the first storage volume V1 is less than the second storage volume V2.

In various embodiments, for example, the foodstuff F or other second item may be placed directly into the second storage area 22. In alternative embodiments, the foodstuff F or other second item may be "prepackaged" in a separate container (e.g., sealed bag, etc.) which is then placed into the second storage area 22. In various embodiments, the bottom 16 of the storage vessel 10 may include an angled interior surface 30 that is intended to facilitate easier extraction of the liquid L by reducing the amount of backward/rearward tilt required for same. In addition, an abutment formation or member 32 may be formed at the top of the first wall member 24 in an effort to prevent or at least retard the product F from spilling out when the vessel 10 is tilted back during consumption of the liquid L. See FIG. 3. The abutment 32 may protrude inwardly into the second storage area from the first wall member 24 and may have a cross-sectional thickness that differs from the cross-sectional thickness of the first wall member 24 and/or the top end wall 14. For example, the abutment 32 may have a cross-sectional thickness that is greater than the cross-sectional thickness of the top end wall 14 to provide, for example, the abutment 32 with more rigidity to help retard inadvertent spillage of the contents within the second storage area 22 when the consumer tips the vessel to drink liquid from the first storage area 18. In addition, the abutment may be advantageously provided with a curved or angled contour (when viewed in cross-section) to further facilitate inadvertent spillage from the second storage area 22 when the vessel is titled as described above. In still other embodiments, the abutment 32 may also have a shape (when, for example, it is viewed from above) that matches at least a portion of the contour of the second access opening 26. For example, the abutment 32 shown in FIGS. 3 and 4 "matches" or "tracks" the curved shape of the portion of the second access opening 26 that corresponds with or is adjacent to the first vertical wall 24.

In various embodiments, the first and second storage areas 18, 22 are completely contained within the sidewall 13 of the body 12. That is, no portions of the first and second storage areas 18, 22 extend or protrude outward from the sidewall 13, top end surface 14, and bottom 16 of the body 12. For those embodiments wherein the body 12 resembles a conventional beer or soda can, such arrangement may enable the vessel to be dispensed by dispensing machines designed to dispense conventional soda and/or beer cans.

As was discussed above, the first storage area 18 may contain a consumable liquid or beverage "L" and the second storage area may contain a food item (e.g., peanuts are shown). In at least some embodiments, the first access opening 20 is smaller than the second access opening 26 which may better enable the consumer to drink the liquid or beverage through the first access opening 20 without spilling the liquid. The second storage area 22 may contain a foodstuff F or other non-consumable item(s) wherein a larger access opening 26 is advantageous. Thus, the first access opening 20 may have a total cross-sectional area that is smaller than a total cross-sectional area of the second access opening. However, depending upon the types of materials contained within the first and second storage areas, the first access opening 20 may be larger than the second access opening 26 and, in still other applications, the first access opening 20 may be substantially equal to the second access opening. Further, the first access opening 20 may have a shape that is similar to the shape of the second access opening 26 or the first and second access openings may have dissimilar shapes.

In addition, the first storage area 18 may at least partially surround the second storage area 22. With reference to this illustrated embodiment, for example, the term "at least partially surrounds" means that the first storage 18 area extends around at least a portion of the first vertical wall portion 24 and first bottom wall portion 25 forming the second storage area 22 as shown in FIG. 3. The wavy line shown in FIG. 3 serves to illustrate, for example, that the consumable liquid "L" substantially surrounds the second storage area 22.

FIGS. 1A-3A illustrate another alternative storage vessel 10' that is substantially the same as storage vessel 10 described above, except that the storage vessel 10' employs an outer seal 28' that covers the first access opening 20' into the first storage area 18' and the second access opening 26' into the second storage area 22'. Thus, the consumer only needs to remove the outer seal 28' to gain access to the consumable liquid and the items contained (foodstuffs, toys, novelties, etc.) in the second storage area 22'. The wavy line shown in FIG. 3A serves to illustrate, for example, that the consumable liquid "L" substantially surrounds the second storage area 22'.

FIGS. 5-9 illustrate an alternative storage vessel 10" that is substantially the same as storage vessel 10 described above, except that storage vessel 10" includes a molded in/integrally formed handle 34 in the body 12 that is intended to provide a better grip for the storage vessel 10", especially if it is larger in shape and/or volume, which can mitigate potential damage to, or implosion of, the storage vessel 10".

Figure 12:
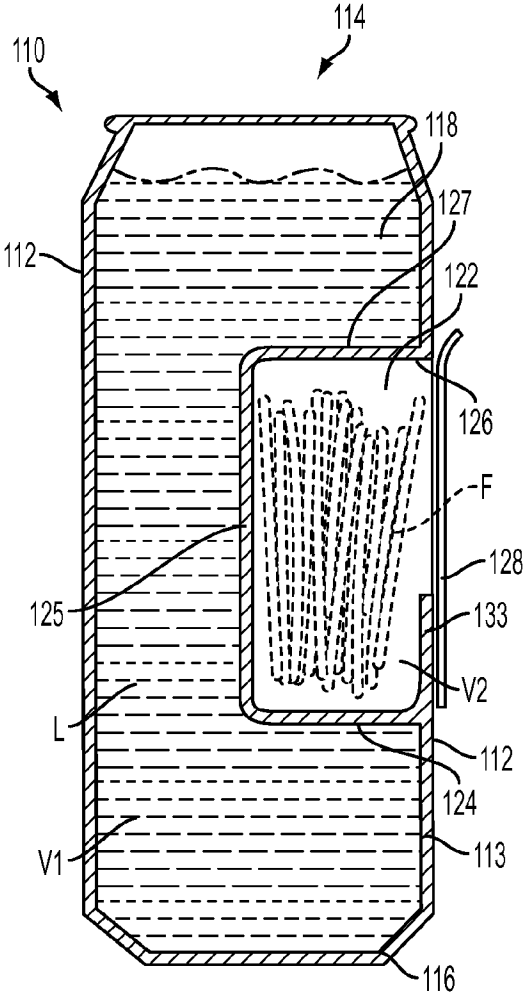
FIG. 12 is a cross-sectional view of the combination beverage and storage vessel embodiment of FIGS. 10 and 11 taken along line 12-12 in FIG. 11.
Figure 11:
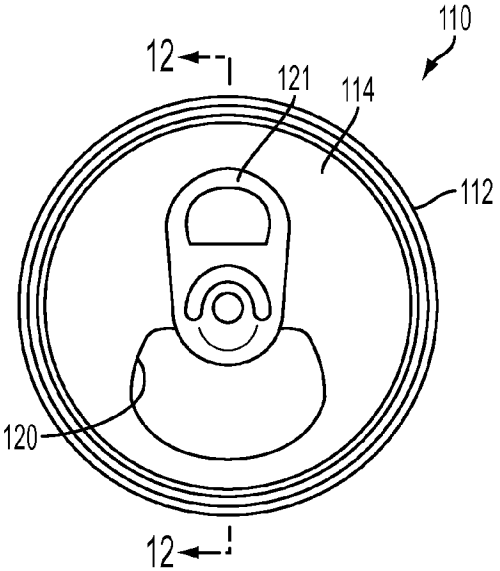
FIG. 11 is a top view of the combination beverage and storage vessel embodiment of FIG. 10.
Figure 10:
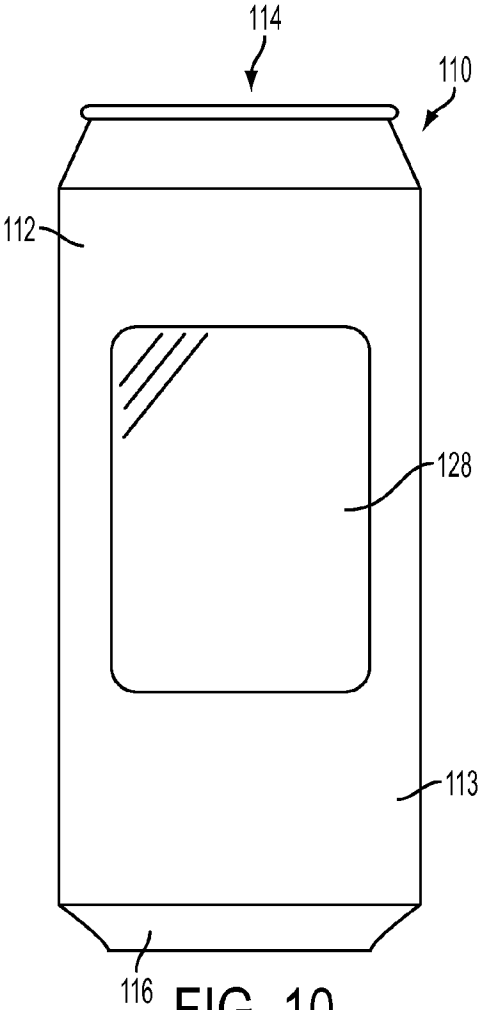
FIG. 10 is an elevational view of another combination beverage and storage vessel embodiment that defines two separate storage areas that may be employed to contain two separate mediums such as, for example, a beverage and a foodstuff.

FIGS. 10-12 illustrate another storage vessel embodiment 110 that comprises a can that may be fabricated from a variety of metals such as aluminum, steel, etc. In other embodiments, however, the storage vessel 110 may be fabricated from various consumer-safe materials such as fibrous, polymer, ceramic materials, etc. that are compatible with the types of liquids and/or foodstuffs to be contained therein. The storage vessel 110 as shown is formed with a body 112, a top end wall 114 and a bottom 116. The top end wall 114 may be integrally formed with the body 112 or it may comprise a separate piece that is otherwise non-removably attached to the body 112 (e.g., by crimping, adhesive, solder, etc.) such that a fluid-tight seal is formed therebetween. For example, the top end wall 114 may be attached to the body portion 112 using conventional attachment methods that are employed in the manufacture of conventional beer and soda cans. The body 112 defines a first storage area 118. As can be seen in FIG. 11, the first storage area 118 is accessible through a first access opening 120 formed through the top end wall 114. In the illustrated embodiment, the first access opening 120 is hermetically sealed by a first seal member in the form of a conventional pull tab arrangement 121. Other forms of removable seals may be employed in alternative embodiments. For example, the first seal may comprise a piece of removable tape or foil. In other embodiments, the first seal may comprise a membrane that is permanently affixed over the first access opening, but which may be readily punctured by, for example, a straw to gain access to the consumable liquid L within the first storage area 118.

As can be most particularly seen in FIG. 12, the storage vessel 110 further includes a "second" storage area 122 that is formed from a first bottom wall portion 124, a first vertical wall portion 125 and a first top wall portion 127 which extends inward from the sidewall 113 that forms the body 112. In the illustrated embodiment, the first wall member 124 comprises an integral portion of the sidewall 113 and defines a second access opening 126 in the body 112 into the second storage area 122. The second access opening 126 may be hermetically sealed with a removable protective cover 128, such as a peel-back foil seal or other suitable means. In other applications, the cover 128 may be omitted. For example, in applications wherein the second storage area 122 supports prepackaged foodstuff "F", the cover 128 may be omitted.

In the illustrated embodiment, the first storage area 118 has a first storage volume V1 and the second storage area 122 has a second storage volume V2 that is smaller than the first storage volume V1. Such storage arrangements are particularly well-suited for holding a pre-filled consumable liquid L, such as, for example, beer, soda, fruit juice, sports drink, etc. in the first storage area 118 and at least one second item such as, for example, an edible material like foodstuff F (potato sticks, pretzels, etc.) or at least one non-consumable item such as a toy or a novelty item in the second storage area 122. In alternative embodiments, the first storage volume V1 is less than the second storage volume V2.

In various embodiments, the foodstuff F or other second item may be placed directly into the second storage area 122. As indicated above, in alternative embodiments, the foodstuff F may be "prepackaged" in a separate container (e.g., sealed bag, etc.) which is then placed into the second storage area 122. In addition, an abutment 133 may be formed or otherwise attached to the sidewall 113 to aid in retaining the foodstuff F or other non-consumable item(s) within the second storage area 122 when the container 110 is tilted in any direction. In one embodiment, for example, the abutment 133 comprises an integral portion of the sidewall 113 and extends about one third of the distance between the first bottom wall portion 124 and the first top wall portion 127. In various embodiments the first and second storage areas 118, 122 are completely contained within the sidewall of the hand-held body portion 112. That is, no portions of the first and second storage areas 118, 122 extend or protrude outward from the sidewall 113 or top and bottom portions thereof. In the illustrated embodiment, the first storage area 118 substantially surrounds the second storage area 122. Thus, when the first storage area 118 is filled or at least substantially filled with a beverage or consumable liquid the liquid may extend around the first bottom wall 125, the first vertical wall 125 and the first top wall 127. For those embodiments wherein the body resembles a conventional beer or soda can, such arrangement may enable the vessel to be dispensed by dispensing machines designed to dispense conventional soda and or beer cans.

Figure 14:
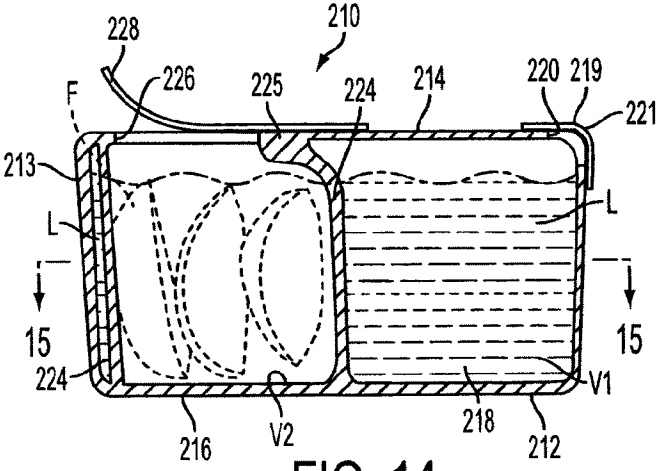
FIG. 14 is a cross-sectional elevational view of the combination beverage and storage vessel embodiment of FIG. 13 taken along line 14-14 in FIG. 13.
Figure 15:
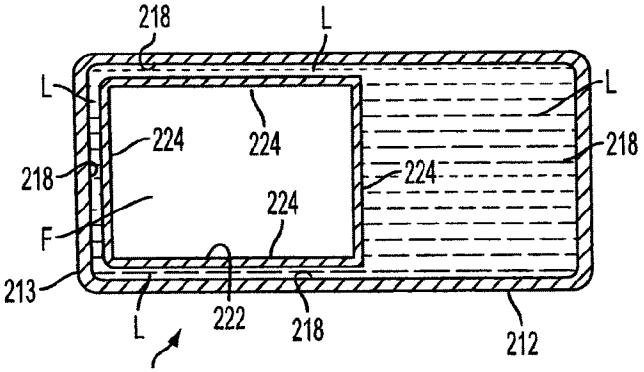
FIG. 15 is a cross-sectional plan view of the combination beverage and storage vessel embodiment of FIGS. 13 and 14 taken along line 15-15 in FIG. 14.
Figure 13:
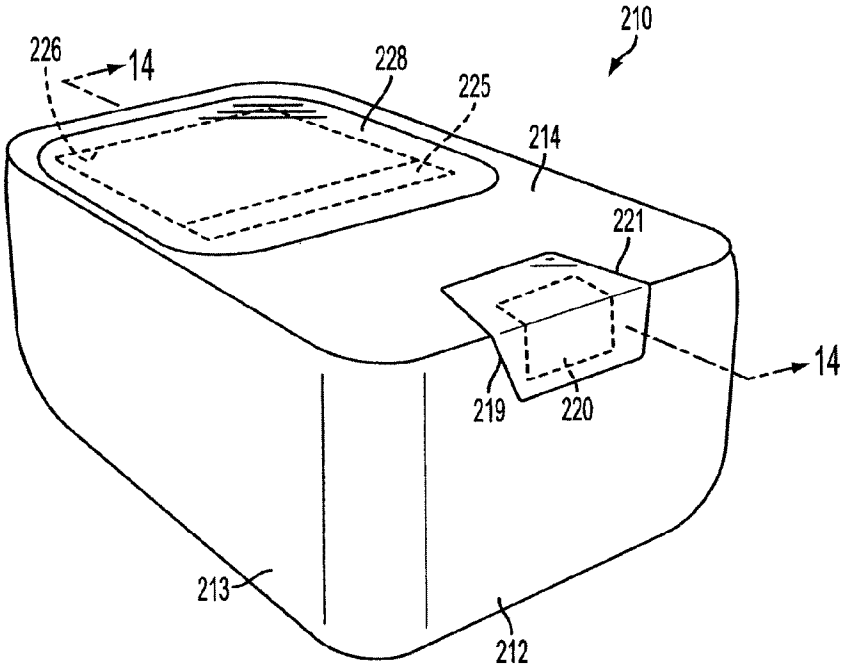
FIG. 13 is a perspective view of another combination beverage and storage vessel embodiment of the present invention.

FIGS. 13-15 illustrate another combination beverage and storage vessel embodiment 210. In various embodiments, the vessel 210 includes a box-shaped body 212 that may be fabricated from, for example, a metal material such as aluminum, steel, etc. or a polymer material or treated cardboard/paper materials that are commonly used in forming milk cartons, juice boxes, etc. The body 212 may be hand-held and include a top end wall 214, a bottom 216 and an outer sidewall 213 that extends therebetween. The top end wall 214 and bottom 216 may be integrally formed with the sidewall 213 in at least one embodiment. The body 212 defines a "first" storage area 218 that has a first storage volume V1 that may contain, for example, a pre-filled consumable liquid L, such as juice or water, extractible through a first access opening 220 that is located through at least one of the top end wall 214 and the outer sidewall 213. In the illustrated embodiment, for example, the first access opening 220 is provided through the corner portion 219 of the body 212 as can be seen in FIG. 14. The first access opening 220 may be hermetically sealed with a removable protective cover 221, such as a peel-back foil seal or a permanently attached punch-through seal if using a straw, etc.

As can be further seen in FIG. 15, a second storage area 222 is integrally formed in the body portion 212 by inner walls 224 which are spaced from the outer wall 213 to enable the first storage area 218 to at least partially surround the second storage area 222. In the illustrated embodiment, for example, the first storage area 218 extends between the inner walls 224 and the outer wall 213. In other embodiments, for example, the first storage area 218 extends only between one inner wall and the outer wall 213. In still other embodiments, the first storage area 218 extends between two of the inner walls 224 and the outer wall 213. Also in further alternative arrangements, the first storage area 218 may extend between the second storage area 122 and the bottom 216 of the body portion and, in still other embodiments, the first storage area 218 may extend between one or more of the inner walls 224 and the outer wall 213. The inner walls 224 may be integrally formed into the body portion 212 or be separately attached thereto using appropriate fastening means (e.g., adhesive, soldering, etc.). In those embodiments wherein the liquid L is placed directly into the first storage area 218 (i.e., the liquid is not first prepackaged in a separate container such as a bag, etc.), the inner walls 224 form a substantially fluid-tight seal with the body portion 212 such that the first storage area 218 is fluid-tight.

A second access opening 226 (FIG. 14) is provided through the top end wall 214. The second storage area 222 has a second storage volume V2 that may be greater than, less than or substantially equal to the first storage volume V1 and may hold at least one second item which may, for example, comprise edible materials like foodstuff F (fruit slices, etc.) or other non-edible items such as toys, novelties, etc. regardless of whether they are prepackaged. That is, in various embodiments, the foodstuff F or other second item may be directly stored in the second storage area 222. In alternative embodiments, the foodstuff F or other second item may be "prepackaged" in a separate container (e.g., sealed bag, etc.) which is then placed into the second storage area 222. As can be seen in FIGS. 13 and 14, a second seal member in the form of, for example, a removable protective cover 228, such as a peel-back foil seal may be employed to cover the second access opening 226.

In addition, an abutment 225 provided at the top of the first wall portion 224 is contemplated to help prevent foodstuff F or other contents from spilling out when the storage vessel 210 is tilted back during consumption of the liquid L. See FIG. 14. The abutment 225 may protrude inwardly into the second storage area 222 from the first wall portion 224 and may have a cross-sectional thickness that differs from the cross-sectional thickness of the first wall portion 224 and/or the top end wall 214. For example, the abutment 225 may have a cross-sectional thickness that is greater than the cross-sectional thickness of the top end wall 214 to provide, for example, the abutment 225 with more rigidity to help retard inadvertent spillage of the contents within the second storage area 222 when the consumer tips the vessel to drink liquid from the first storage area 218. In addition, the abutment may be advantageously provided with a curved or angled contour (when viewed in cross-section) to further facilitate inadvertent spillage from the second storage area 222 when the vessel is titled as described above. In still other embodiments, the abutment 225 may also have a shape (when, for example, it is viewed from above) that matches at least a portion of the contour of the second access opening 226.

In various embodiments the first and second storage areas 218, 222 are completely contained within the outer sidewall 213 of the hand-held body portion 212. That is, no portions of the first and second storage areas 218, 222 extend or protrude outward from the outer sidewall 213 or top end wall and bottom thereof. In FIG. 14, the horizontally-extending wavy broken line represents a level of the liquid L within the first storage area 218 (including the portions of the first storage area extending between the inner walls 224 and the outer wall 213).

Figure 17:
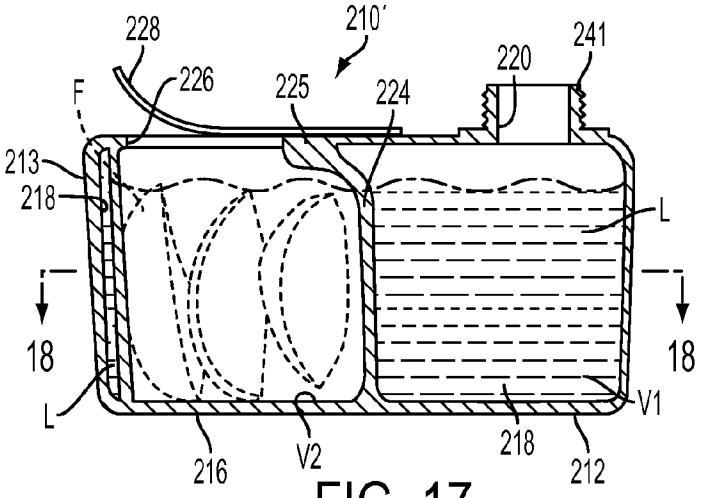
FIG. 17 is a cross-sectional elevational view of the combination beverage and storage vessel embodiment of FIG. 16 taken along line 17-17 in FIG. 16.
Figure 18:
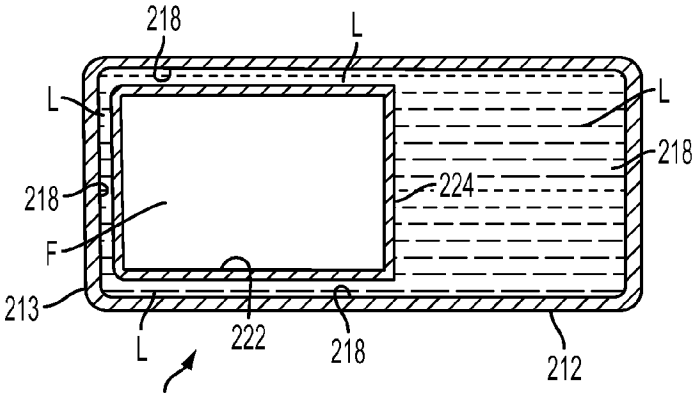
FIG. 18 is a cross-sectional plan view of the combination beverage and storage vessel embodiment of FIGS. 13 and 14 taken along line 18-18 in FIG. 17.
Figure 16:
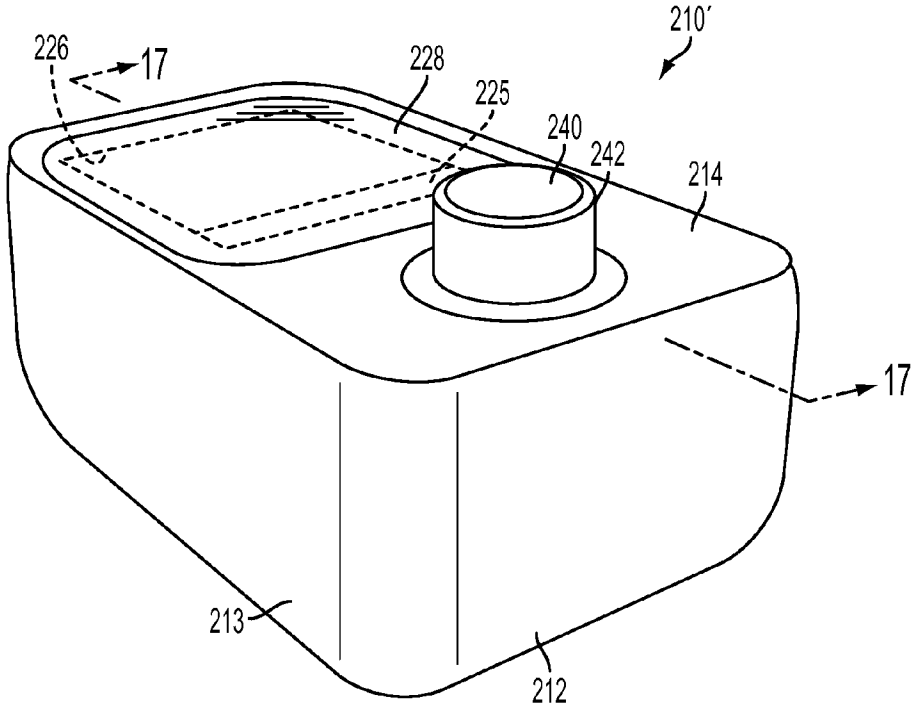
FIG. 16 is a perspective view of another combination beverage and storage vessel embodiment of the present invention.

FIGS. 16-18 illustrate another beverage and storage vessel 210' that is substantially the same as beverage and storage vessel 210 described above, except that liquid L is extractible through a hermetically sealable spout 240. Such arrangement may comprise, for example, a cap 242 is threaded to a threaded nipple 241 that is formed in the top end portion of the storage vessel. In addition, an abutment 225 is provided at the top of the first wall portion 224 to help prevent product F (for example, gelatin, custard, etc.) from spilling out when the vessel 210' is tilted back during consumption of the liquid L. In alternative embodiments, the spout may comprise a conventional "push/pull" spout or swivelable, rotatable or folding spout. In FIG. 17, the horizontally-extending wavy broken line represents a level of the liquid L within the first storage area 218 (including the portions of the first storage area extending between the inner walls 224 and the outer wall 213).

Figure 20:
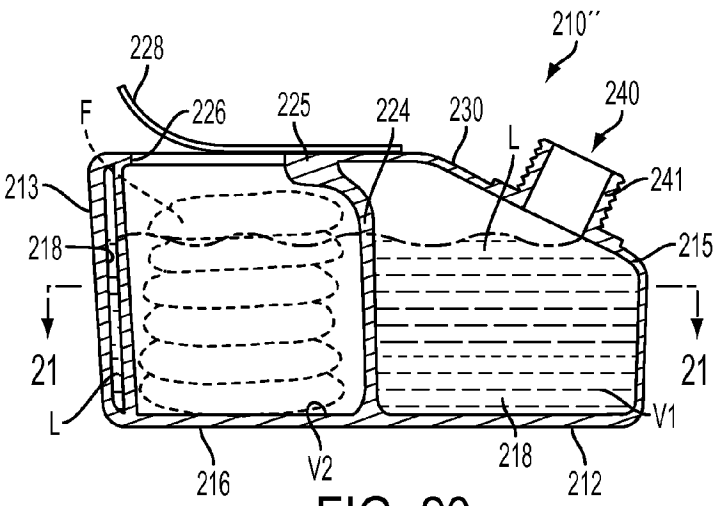
FIG. 20 is a cross-sectional elevational view of the combination beverage and storage vessel embodiment of FIG. 19 taken along line 20-20 in FIG. 19.
Figure 21:
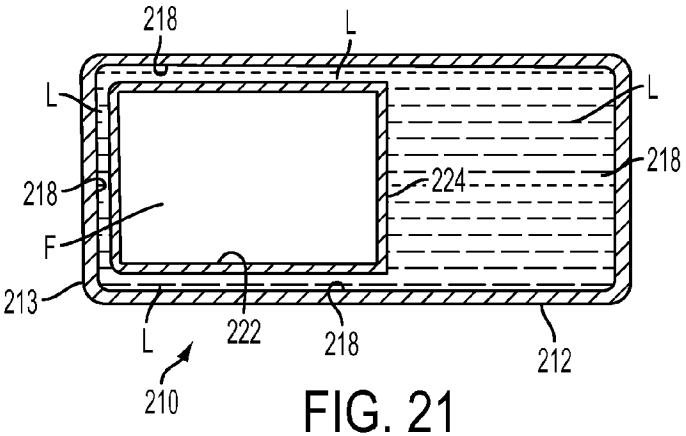
FIG. 21 is a cross-sectional plan view of the combination beverage and storage vessel embodiment of FIGS. 19 and 20 taken along line 21-21 in FIG. 20.
Figure 19:
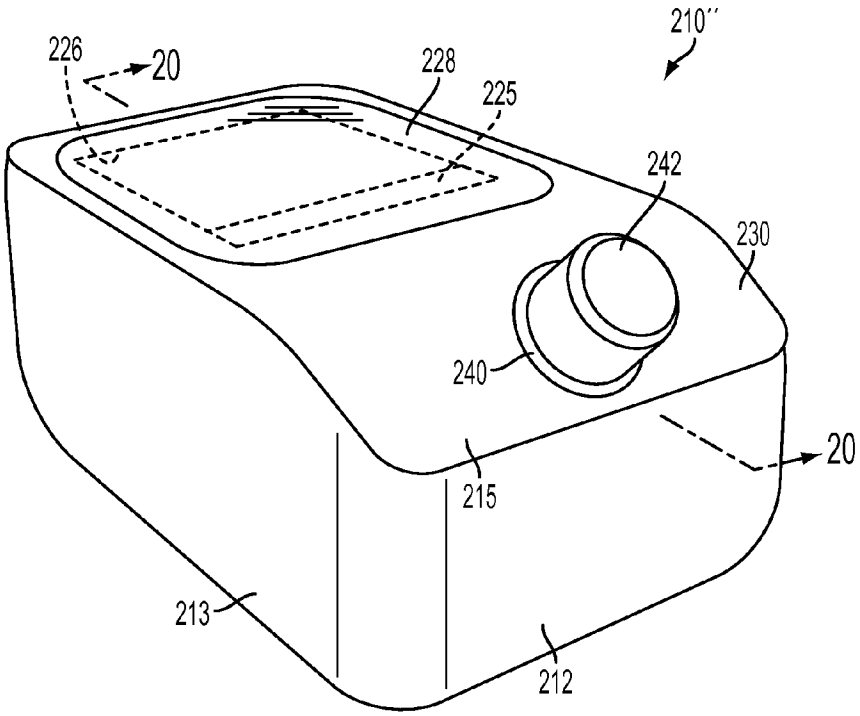
FIG. 19 is a perspective view of another combination beverage and storage vessel embodiment.
Figure 24:
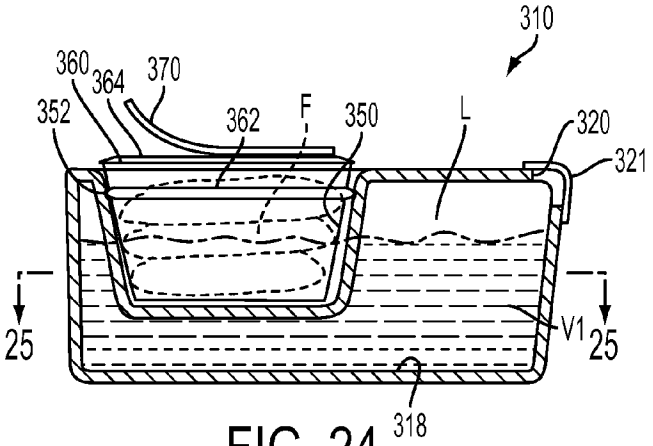
FIG. 24 is a cross-sectional elevational view of the combination beverage and storage vessel embodiment of FIGS. 22 and 23 taken along line 24-24 in FIG. 22.

FIGS. 19-21 illustrate another beverage and storage vessel 210" that is substantially the same as beverage and storage vessel 210 described above, except that the top end portion 214 of the vessel 210" has an angled portion 230 on which the twist open spout 240 is located to facilitate easier extraction of the liquid L by reducing the amount of backward/rearward tilt required for same. In alternative embodiments, the spout may comprise a conventional "push/pull" spout or swivelable, rotatable or folding spout. In FIG. 21, the second item or foodstuff F is depicted as cookies. But as with other various embodiments, the second item may comprise a foodstuff F consisting of a variety of different edible items such as crackers, chips, pretzels, etc. and/or comprise at least one non-edible item such as a toy, novelty, etc. The liquid L may comprise, for example, chocolate milk. However, liquid L could comprise a variety of different consumable beverage materials.

Figure 25:
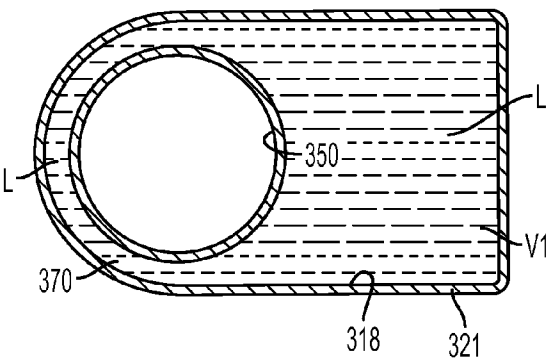
FIG. 25 is a cross-sectional plan view of the combination beverage and storage vessel embodiment of FIGS. 22-24 taken along line 25-25 in FIG. 24.
Figure 22:
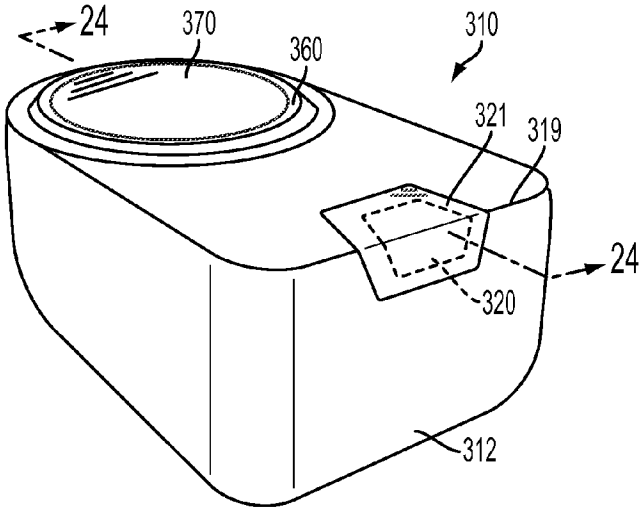
FIG. 22 is a perspective view of another combination beverage and storage vessel embodiment.

FIGS. 22-25 illustrate another combination beverage and storage vessel 310 which defines a "first" storage area 318 that has a first storage volume V1. The first storage area may contain, for example, a consumable liquid L, such as juice, water, milk, etc. that is extractible through a first access opening 320 that is located through a corner portion 319 (or other portion) of the box body 312 as can be seen in FIG. 25. In various embodiments, the storage vessel 310 comprises a body 312 that may be fabricated from, for example, a metal such as aluminum, steel, etc. or various polymer materials. The first access opening 320 may be hermetically sealed with a removable protective cover 321, such as a peel-back foil seal or punch-through seal if using a straw.

Figure 23:
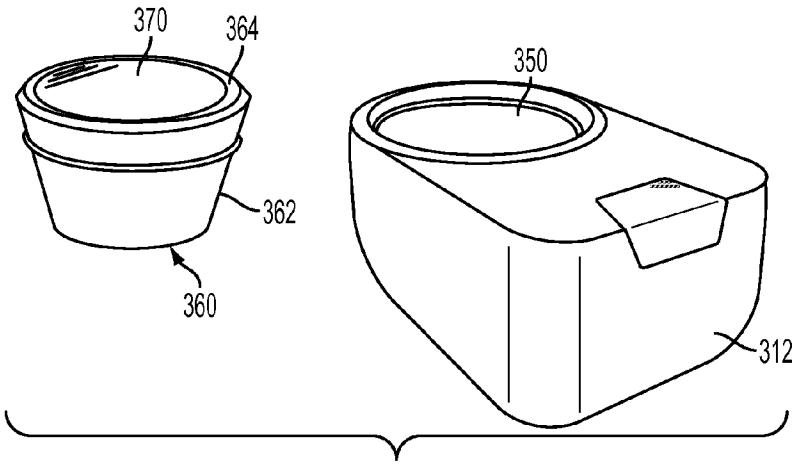
FIG. 23 is an exploded assembly view of the combination beverage and storage vessel embodiment of FIG. 22 with the second storage container detached from the vessel body.
Figure 28:
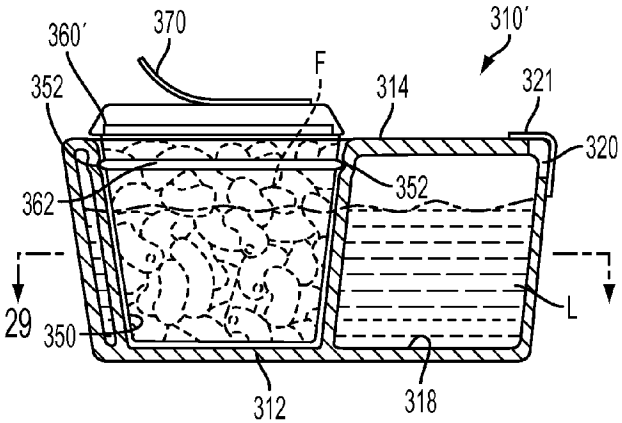
FIG. 28 is a cross-sectional elevational view of the combination beverage and storage vessel embodiment of FIG. 26 taken along line 28-28 in FIG. 26.

As can be seen in FIGS. 23 and 25, the body 312 has an integrally-formed recessed cavity 350 partially extending downward into it. In at least one embodiment, the recessed cavity 350 is so located within the first storage area 318 such that a portion of the first storage area 318 surrounds or at least partially surrounds at least a portion of the recessed cavity 350. Thus, the temperature of the consumable liquid L contained within the first storage area 318 may be used to influence the temperature of the contents of a separate second storage container 360 installed within the recessed cavity 350. Such second separate storage container 360 may contain at least one second item which may comprise, for example, edible materials like foodstuff F (cookies, candy, fruit, peanut brittle, etc.) or other consumables or non-edible product (toys, novelties, etc.) regardless of whether they are prepackaged.

In various embodiments, the second storage container 360 has at least one retainer formation in the form of a protrusion or ring 362 around/on its exterior so as to engage an indentation/groove/notch 352 inside the cavity 350—or, if reversed (not shown), with at least one notch outwardly extending from cavity 350 so as to engage at least one retainer indentation on the second storage container 360 intended to hold the second storage container 360 in place in a "snap-in" relationship for example. In at least one embodiment, when the second storage container 360 is retainingly seated within the cavity 350, a top surface 364 of the second storage container 360 is substantially flush or even with a top surface 314 of the vessel 310. Stated another way, the top surface 364 is not spaced-apart from the top surface or end wall 314 of the vessel 310 a distance that would cause the storage container 360 to interfere with the consumer as the consumer tilts the vessel 310 to drink through the first access opening 320. The "snap-in" storage container 360 might also be provided with a removable cover or second seal member 370. As can be seen in FIGS. 23 and 25, the second storage container 360 may have a tapered outer wall that is sized and shaped to be retainingly received within a correspondingly shaped cavity 350. However, the second storage container and cavity may be provided in other shapes and configurations.

Figure 29:
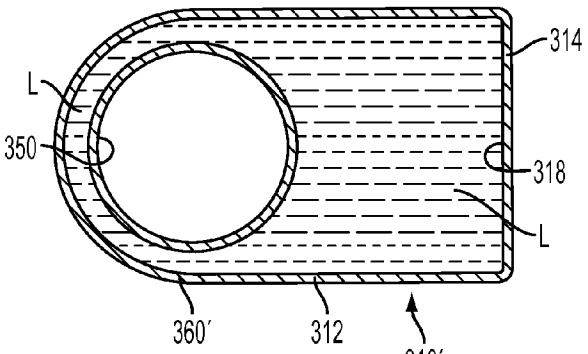
FIG. 29 is a cross-sectional plan view of the combination beverage and storage vessel embodiment of FIGS. 26-28 taken along line 29-29 in FIG. 28.
Figure 26:
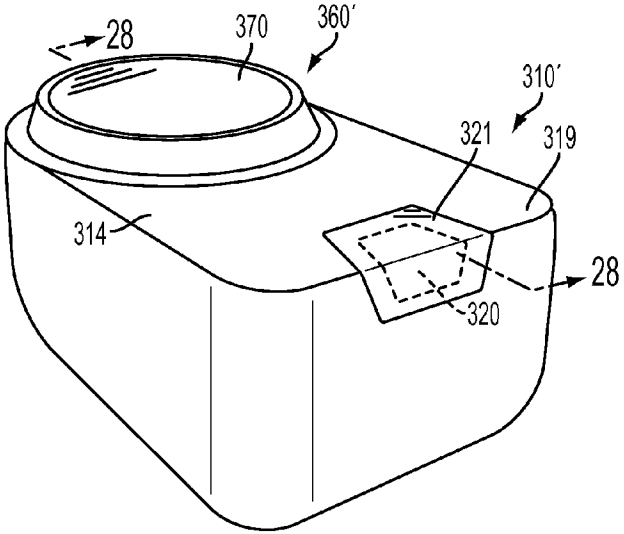
FIG. 26 is a perspective view of another combination beverage and storage vessel embodiment.
Figure 27:
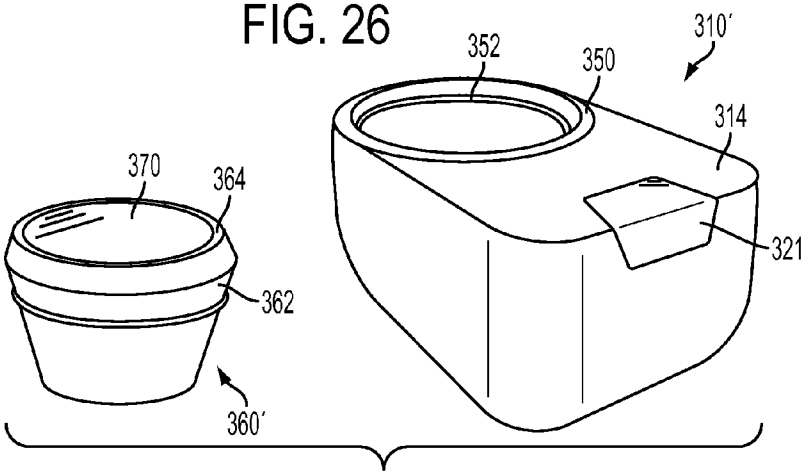
FIG. 27 is an exploded assembly view of the combination beverage and storage vessel embodiment of FIG. 26 with the second storage container detached from the vessel body.

FIGS. 26-29 illustrate another beverage and storage vessel 310' that is substantially the same as beverage and storage vessel 310 described above, except that when the second storage container 360' is "snappingly" seated within the cavity 350', the top surface 364 extends a small distance above the top portion 314 of the vessel 310'. In FIG. 29, the foodstuff F is depicted as macaroni and cheese. But as with other various embodiments, the foodstuff F may comprise a variety of different edible items (fruit salad, macaroni, spam, etc.) or other consumables or non-edible product (toys, novelties, etc.) regardless of whether they are prepackaged. Likewise, the first storage area 318 may hold a variety of consumable liquid products such as, for example, soup.

Figure 31:
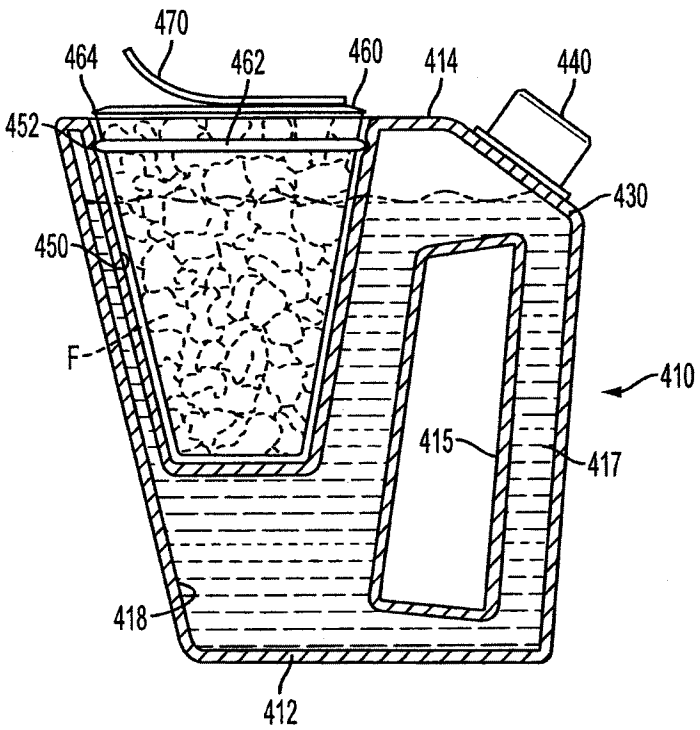
FIG. 31 is a cross-sectional elevational view of the combination beverage and storage vessel embodiment of FIG. 30.
Figure 30:
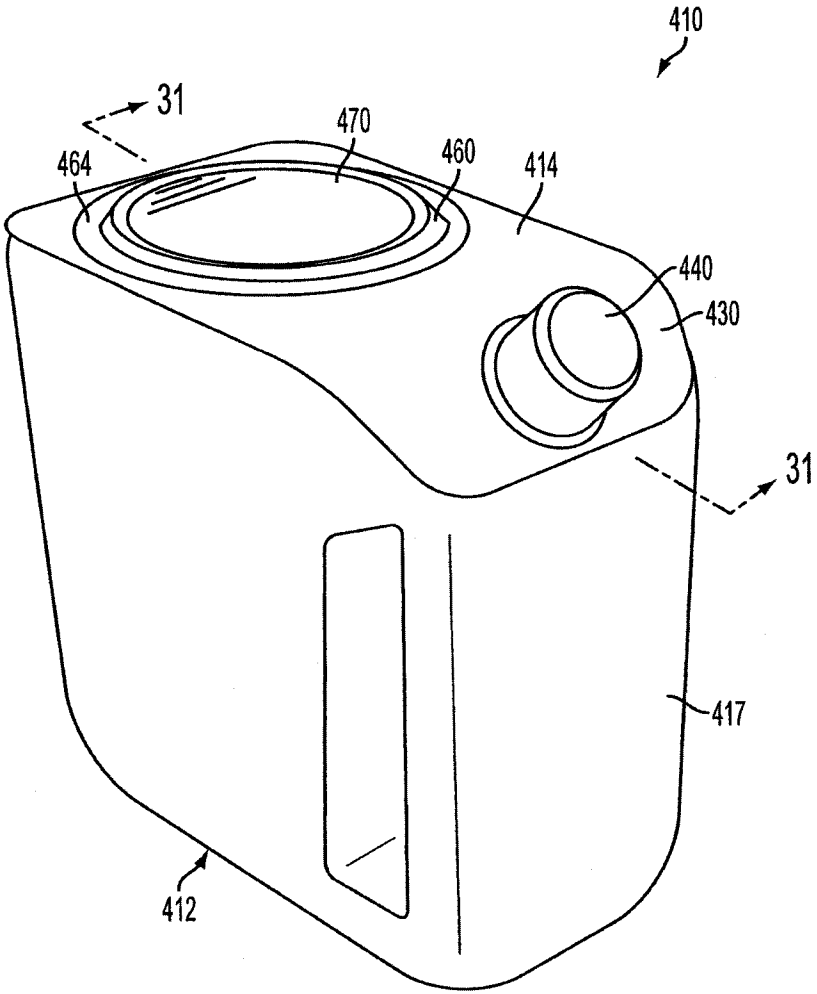
FIG. 30 is a perspective view of another combination beverage and storage vessel embodiment.

FIGS. 30 and 31 illustrate another combination beverage and storage vessel embodiment 410. As can be seen in those Figures, the vessel 410 may have a body 412 that resembles or comprises an upstanding or elongated box that has a handle 417 formed thereon by an opening 415 that extends completely through a body 412 of the storage vessel 410. In alternative arrangements, the handle 417 may be formed from recesses in the body 412. The body 412 may be integrally fabricated from, for example, a metal such as aluminum, steel, etc. or various polymer materials. The body 412 defines a "first" storage area 418 having a first storage volume V1 that may contain, for example, a pre-filled consumable liquid L, such as lemonade, etc. The consumable liquid L is accessible through a hermetically sealed spout 440 seated on an angled surface 430 of vessel 410 intended to facilitate easier extraction of the liquid L by reducing the amount of backward/rearward tilt required for same. In other arrangements, the spout may comprise, for example, a push/pull spout, swivelable, rotatable or folding spout.

As can be seen in FIG. 31, the body 412 has an integrally formed recessed cavity 450 partially extending downward into it. In at least one embodiment, the recessed cavity 450 is so located within the first storage area 418 such that a portion of the first storage area 418 surrounds or at least partially surrounds at least a portion of the recessed cavity 450. Thus, the temperature of the consumable liquid L contained within the first storage area 418 may be used to influence the temperature of the contents of a separate second storage container 460 installed within the recessed cavity 450. The second separate storage container 460 may contain, for example, edible materials like foodstuff F (popcorn, etc.) or other consumables or non-edible product (toys, novelties, etc.) regardless of whether they are prepackaged. In various embodiments, the second storage container 460 has at least one retainer formation which may comprise a protrusion or ring 462 formed around/on its exterior so as to engage an indentation/groove/notch 452 inside the cavity 450—or, if reversed (not shown), with at least one notch outwardly extending from cavity 450 so as to engage at least one indentation on the second storage container 460 intended to hold the second storage container 460 in place in a "snap-in" relationship for example. In at least one embodiment, when the second storage container 460 is retainingly seated within the cavity 450, a top surface 464 of the second storage container 460 is substantially flush or even with a top surface 414 of the vessel 410. The snap-in storage container 460 might have a removable protective cover or second seal member 470. As can be seen in FIG. 31, the second storage container 460 may have a tapered outer wall that is sized and shaped to be retainingly received within a correspondingly shaped cavity 450. However, the second storage container and cavity may be provided in other shapes and configurations. As can be seen in FIG. 31, the first storage area 418 completely encompasses the inner spaces of handle 415 and the integrally formed recessed cavity 450, thus maximizing the amount of consumable liquid L that may be contained therein.

Figure 33:
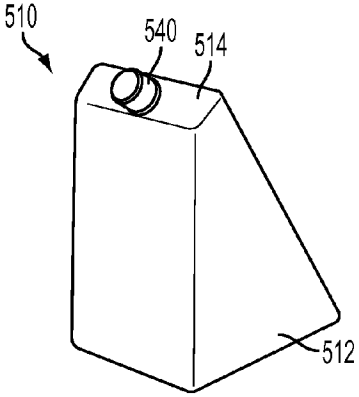
FIG. 33 is a rear perspective view of the combination beverage and storage vessel embodiment of FIG. 32.
Figure 34:
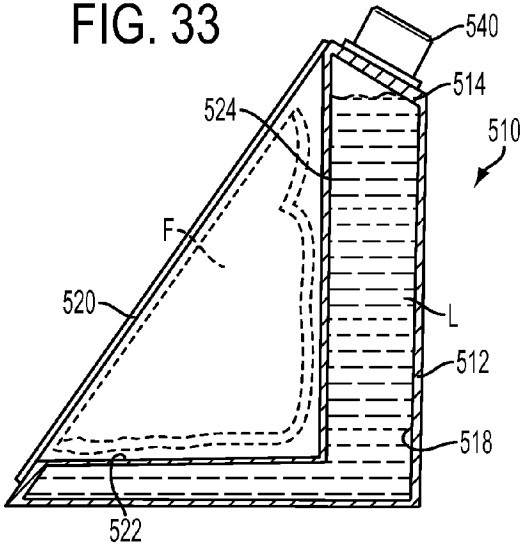
FIG. 34 is a cross-sectional view of the combination beverage and storage vessel embodiment of FIGS. 32 and 33.
Figure 32:
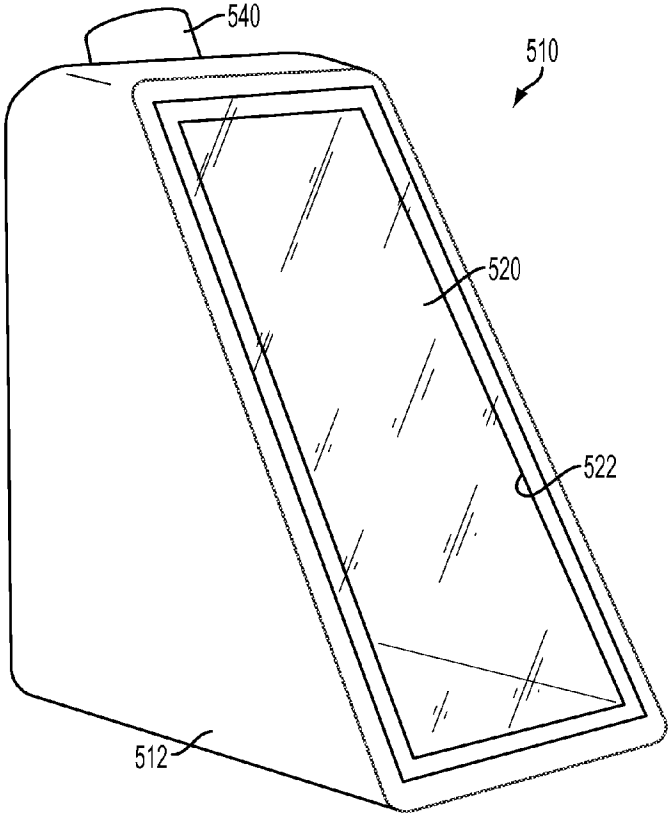
FIG. 32 is a front perspective view of another combination beverage and storage vessel embodiment.
Figure 38:
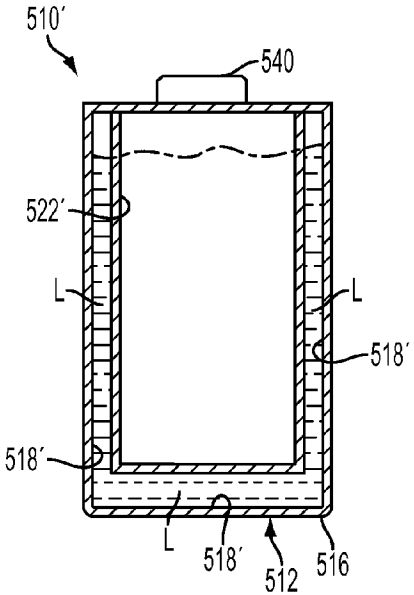
FIG. 38 is a front cross-sectional view of the combination beverage and storage vessel embodiment of FIGS. 35-37.
Figure 35:
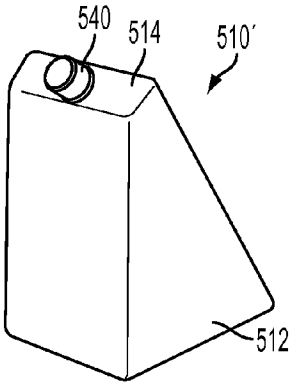
FIG. 35 is a rear perspective view of another combination beverage and storage vessel embodiment.
Figure 37:
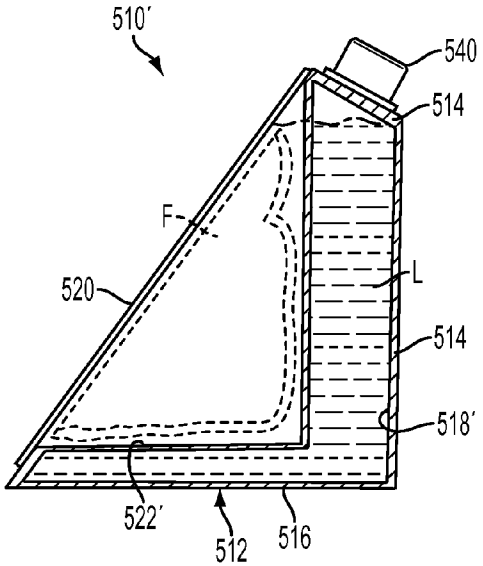
FIG. 37 is a side cross-sectional view of the combination beverage and storage vessel embodiment of FIGS. 35 and 36.
Figure 36:
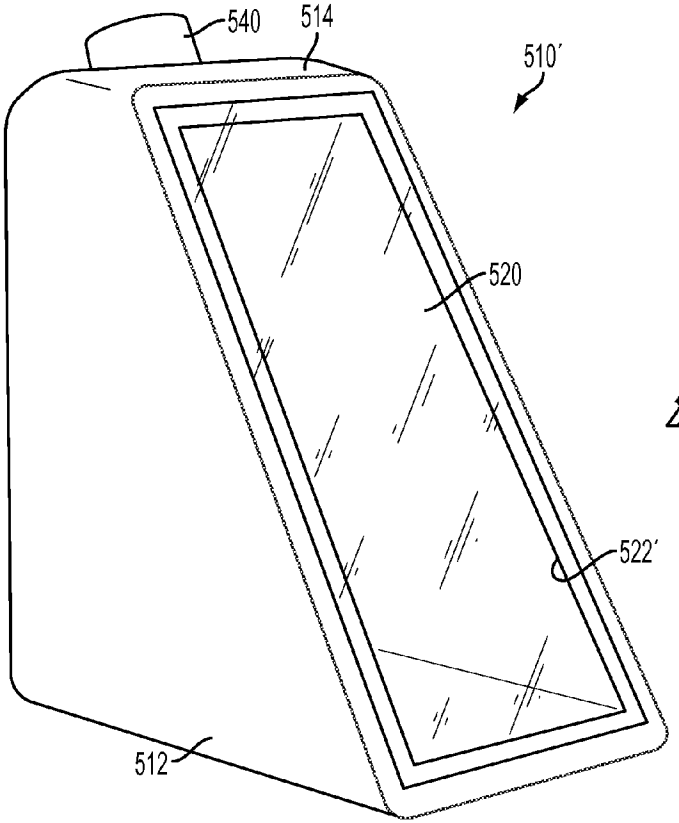
FIG. 36 is a front perspective view of the combination beverage and storage vessel embodiment of FIG. 35.

FIGS. 32-34 illustrate another combination beverage and storage vessel embodiment in the shape of a sandwich container 510 intended to hold edible foodstuff F (normally at least one and preferably two triangular-shaped half-sandwich wedges). In at least one form, for example, the sandwich container or vessel includes a body 512 that has a recessed cavity 522 configured to support the sandwich wedges F therein. However, those of ordinary skill in the art will readily appreciate that the container, or more particularly, the cavity, may be provided in other shapes that are tailored to other food items having non-triangular shapes. For example, the cavity may be provided in a substantially round shape that may accommodate one or more bagel portions, donut(s), etc. In still other arrangements, for example, the cavity may be configured to accommodate one or more food items that have a substantially crescent shape.

A removable protective cover 520, such as a peel-back plastic seal, may or may not be employed to cover the cavity 522 and retain the sandwich wedges F within the cavity 522 prior to use. The cover 520 may be transparent to enable a consumer to view the sandwich wedges F therethrough or the cover may be opaque. In at least one embodiment, the body 512 is fabricated from, for example, a polymer material. The polymer material, for example, may be transparent to enable the consumer to view the liquid L therethrough or it may be provided with various degrees of opacity. In at least one form, a first wall portion 524 is integrally formed with or otherwise attached to the body 512 to define a first substantially fluid-tight storage area 518 that may be shaped as shown in FIG. 34. For example, the first storage area 518 may be substantially L-shaped such that a portion of the first storage area 518 extends under the bottom of the cavity 522. The first storage area 518 may hold for example a consumable liquid beverage L such as, for example, soda pop. The beverage L is accessible through a hermetically sealed spout 540 that is formed on an angled wall portion 514 of the body portion 512 which is intended to facilitate easier extraction of the liquid L by reducing the amount of backward/rearward tilt required for same. As can be most particularly seen in FIG. 34, in at least one embodiment, the first storage area 518 extends around two sides of the cavity 522. It is further contemplated that the temperature of the liquid L in the first storage area 518 may be used to influence at least temporarily the temperature of the items contained within the cavity 522. Other spout arrangements and seals disclosed herein (e.g., peel-back seal, push/pull spout, etc.) may also be employed.

FIGS. 35-38 illustrate another beverage and storage vessel 510' that is substantially the same as beverage and storage vessel 510 described above, except that the first storage area 518' surrounds a narrower recessed inner cavity 522' on all four sides, thus maximizing the amount of consumable liquid L contained therein.

Figure 40:
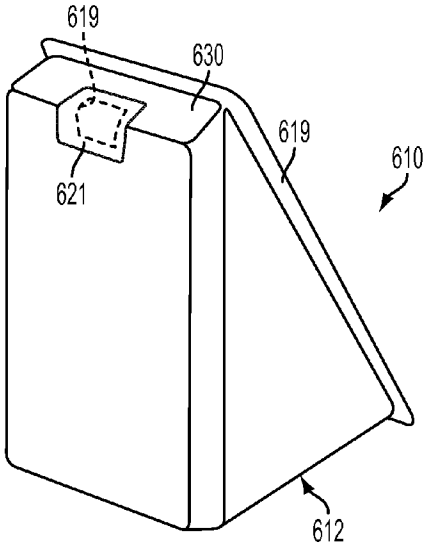
FIG. 40 is a rear perspective view of the combination beverage and storage vessel embodiment of FIG. 39.
Figure 41:
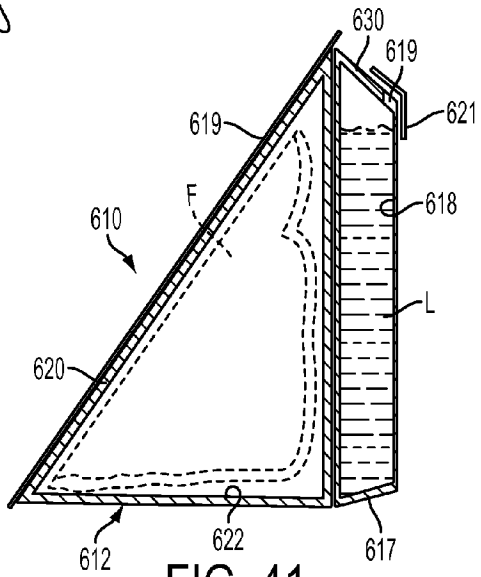
FIG. 41 is a side cross-sectional view of the combination beverage and storage vessel embodiment of FIGS. 39 and 40.
Figure 39:
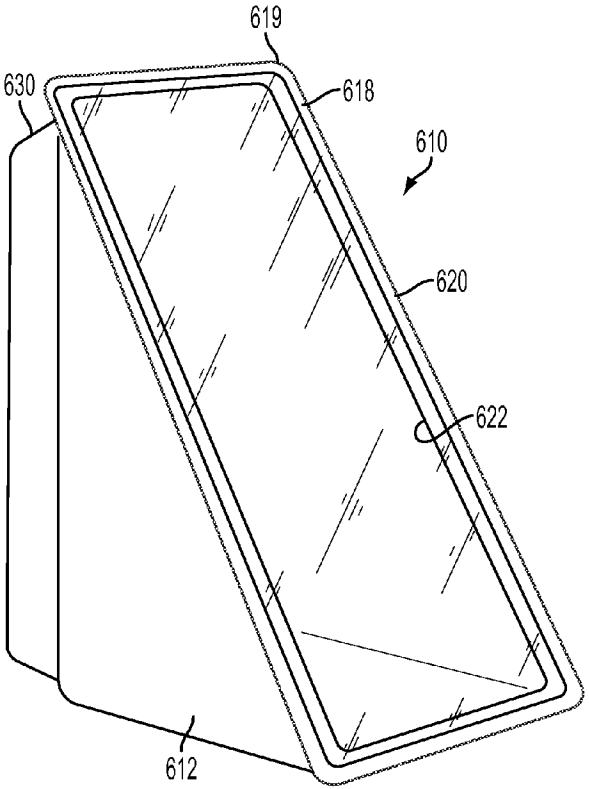
FIG. 39 is a front perspective view of another combination beverage and storage vessel embodiment.

FIGS. 39-41 illustrate another combination beverage and storage vessel 610 intended to hold edible foodstuff F (normally a pair of triangular half-sandwich wedges). The storage vessel 610 comprises a body 612 that has a recessed cavity 618 formed therein that is intended to receive at least one and preferably a pair of sandwich wedges therein. The sandwich wedges may be retained within the cavity 618 by a removable cover 620, such as a peel-back plastic seal in the above-described manner. In at least one embodiment, the body 612 may be fabricated from, for example, a polymer or other suitable material as described herein. In at least one embodiment, for example, an outer rim 619 is formed around the cavity 618 that helps prevent the vessel 610 from tipping over.

In the embodiment illustrated in FIGS. 39-41, a first storage area 618 is formed in a separate vessel 616 that is attached to the body 612 by a suitable adhesive, double-sided tape, etc. In other embodiments, however, the first storage area 618 is integrally formed in the body 612. In both arrangements, for example, the first storage area 618 may hold a pre-filled consumable liquid L, such as herb tea or other consumable liquid which is accessible through an opening 619 that is hermetically sealed by a removable protective cover 621, such as a peel-back foil seal or punch-through seal if using a straw. Other embodiments, however, may employ one of the various forms of spout arrangements disclosed herein. The opening 619 may be provided through an angled wall portion 630 intended to facilitate easier extraction of the liquid L by reducing the amount of backward/rearward tilt required for same. Additionally, lower rear wall portion 617 might be angled to help balance the vessel or, again, to facilitate easier extraction of the liquid L by reducing the amount of backward/rearward tilt required for same.

Figure 43:
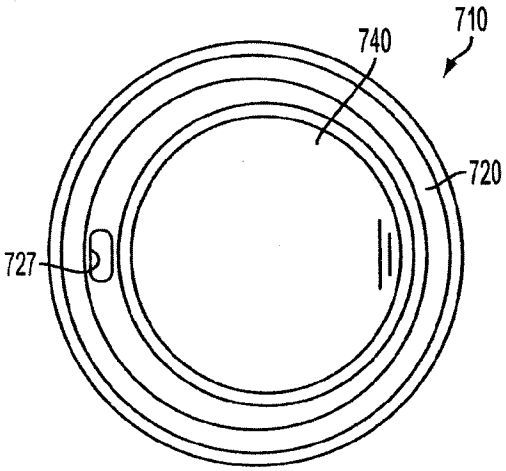
FIG. 43 is a top view of the combination beverage and storage vessel embodiment of FIG. 42.
Figure 44:
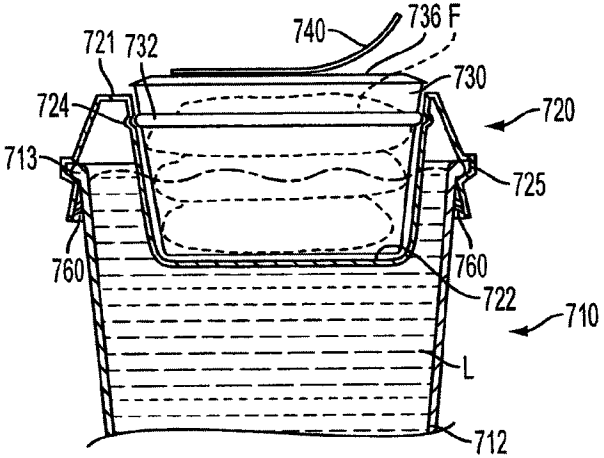
FIG. 44 is a partial side cross-sectional view of the combination beverage and storage vessel embodiment of FIGS. 42 and 43.
Figure 42:
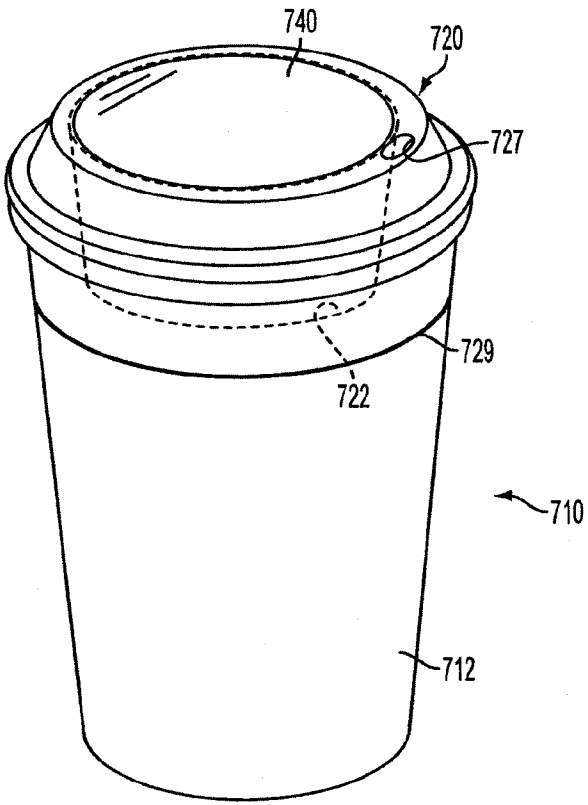
FIG. 42 is a perspective view of another combination beverage and storage vessel embodiment.

FIGS. 42, 43, and 44 illustrate a combination beverage and storage vessel embodiment 710 that resembles the shape of a common disposable coffee cup. The vessel 710 comprises a cup body 712 and a locking or non-removable lid 720 that defines an integrally-formed recessed cavity 722 that is intended to contain a product. The product may include, but is not limited to, edible materials like foodstuff F (brownies or sugar cookies, etc.) or other non-edible products (toys, novelties) regardless of whether they are prepackaged or to contain a separate second container 730 with like-contents regardless of whether it is prepackaged. When a second container is not employed, a seal or cover may or may not be employed to retain the foodstuff F in the recessed cavity 722. In the illustrated embodiment, a second container 730 is illustrated. In at least one embodiment, the second container 730 includes at least one retainer formation in the form of a protrusion or ring 732 that extends around or is on its exterior that is configured to retainingly engage an indentation/groove/notch or retention feature 724 located in the wall of the cavity 722 that is intended to releasably retain the second container 730 in place. In alternative embodiments, the second container may be formed with at least one groove or indentation that is configured to releasably engage corresponding protrusions formed on the wall of cavity 722. In either case, once the second container is properly seated within the cavity 722, a top surface 736 of the second container 730 may be substantially flush with the top surface 721 of the lid 720. The recessed cavity 722 or second storage container 730 might also utilize a removable cover or seal member 740, such as a peel-back foil seal, to retain the foodstuff F therein prior to use.

The lid 720 has a mouth hole 727 which may remain open and unsealed to provide adequate ventilation of liquid L when necessary or the mouth hole 727 may be hermetically sealed with a removable seal (not shown). The locking lid 720 is configured to non-removably mate with to the cup body 712, which may comprise a disposable cup, after the cup body 712 has been filled with a liquid L, such as coffee, hot chocolate, tea, etc. to a designated level. As used in this context, the term "non-removably" refers to the inability for the end user to remove the lid from the cup body after the lid has been attached thereto without damaging the lid and/or cup body to such an extent as to render the lid and/or cup body unusable for their intended purpose. The designated level may be defined by an imprinted line 729 that is intended to prevent liquid L from overflowing the cup body 712 when the lid 720 is retainingly attached thereto. The lid 720 may also have a retaining rim or skirt 725 formed therearound to affix the lid 720 to the cup body 712. Downward pressure is applied to its concave rim 725 forcing it over a lip 713 formed on the cup body 712. Such action causes a number of angled tines or barbs 760 (one-way retainers) formed on the inside of the rim 725 to engage the outer surface of the cup body 712 in a manner which prevents the lid 720 from being removed by the consumer. Such arrangement forms a single-piece, pre-filled—and pre-consumer—combination beverage and storage vessel intended to hold a measured amount of pre-filled consumable liquid L and edible materials like foodstuff F (brownies or sugar cookies, etc.) or other product seated within said cavity 722.

Figure 47:
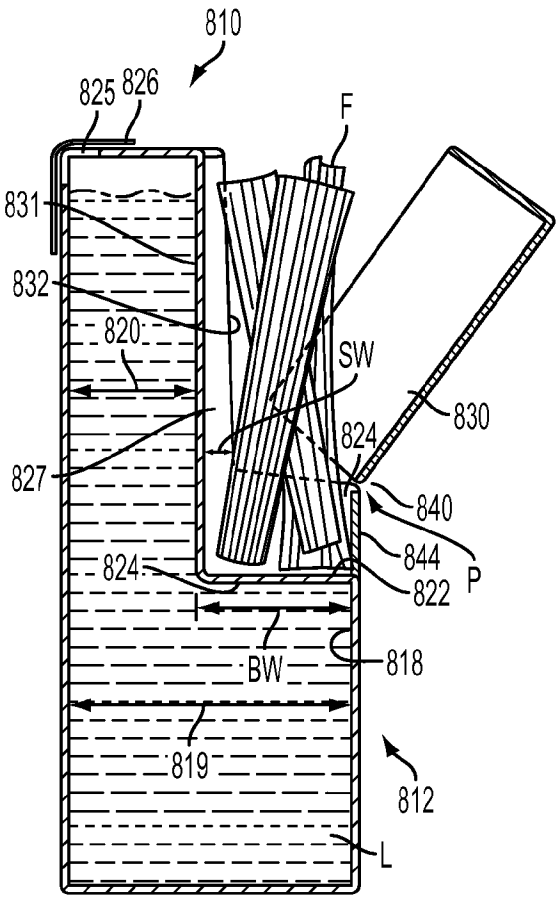
FIG. 47 is a side cross-sectional view of the combination beverage and storage vessel embodiment of FIGS. 45 and 46.
Figure 46:
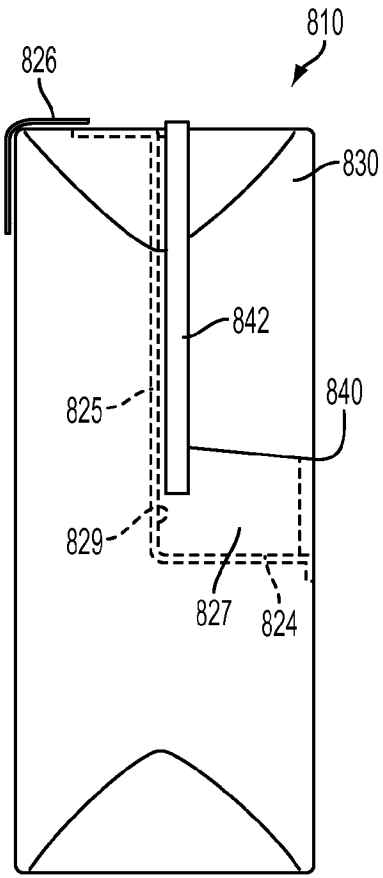
FIG. 46 is a side elevational view of the combination beverage and storage vessel embodiment of FIG. 45.
Figure 45:
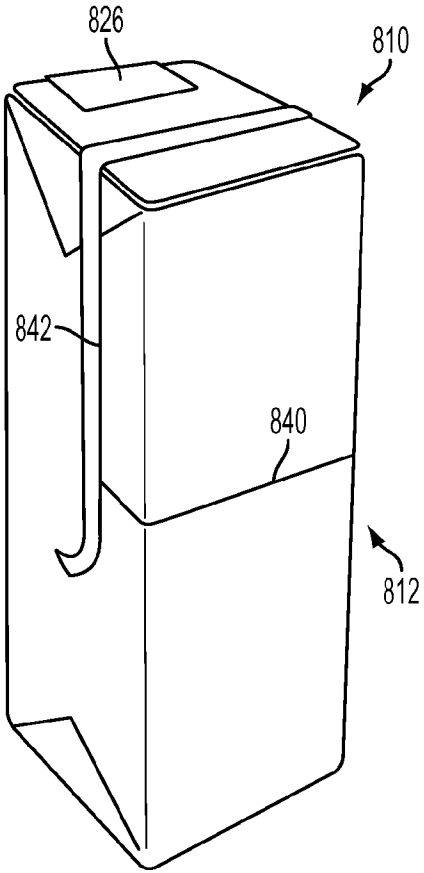
FIG. 45 is a perspective view of another combination beverage and storage vessel embodiment.

FIGS. 45-47 illustrate an imaginative new combination beverage and storage vessel embodiment in the shape of an elongated or upstanding box 810. In various embodiments, the box 810 comprises a body 812 that may be fabricated from, for example, cardboard or similar materials employed when manufacturing a variety of different conventional juice box arrangements. The body 812 may be fabricated as shown in FIG. 47 and include a top end wall 814 and at least one upstanding vertical wall 813 that serve to define a first storage area 818 that has a larger bottom portion 819 and a narrower upper portion 820. For example, in the illustrated embodiment, the bottom portion 819 has a volume that is larger than a volume of the upper portion 820. The first storage area 818 may hold a pre-filled consumable liquid L, such as vegetable juice, extractible through a mouth hole 825 that is hermetically sealed with a removable cover 826, such as a peel-back foil seal or punch-through seal if using a straw.

Referring now to FIG. 47, in at least one form, the box 810 includes a second notched storage area 822. The second storage area 822 may be formed, for example, from a bottom wall portion 824 and a vertically-extending rear wall portion 831. The bottom wall portion 824 and the rear wall portion may be formed from a single wall member as shown in FIG. 47. In addition, the second storage area 822 may be further defined by two side wall portions 827 and a front abutment 844. In at least one arrangement, the bottom wall portion 824 has a bottom width "BW" and each of the two side walls has a sidewall width "SW" that is less than the bottom width BW. The bottom wall portion 824, the two sidewall portions 827 and the front abutment 844 cooperate to form a somewhat shallow pocket 829 which helps to prevent or retard the product F from spilling out should the box 810 be tilted in various directions.

As can be seen in FIG. 47, the box 810 further includes a closure member 830 that covers an opening 832 into the second storage area 822. In one form, for example, the closure member 830 resembles a "clam-shell" arrangement that is movably or otherwise pivotally attached to the box 810. More particularly, as shown in FIG. 47, the closure member 830 is pivotally attached to the front abutment 844 for pivotal travel relative thereto along edge "P". The closure member 830 is movable from a closed position wherein the second storage area 822 is completely enclosed to various open positions wherein access may be provided to the contents thereof. For example, the second storage area 822 may contain a product, including, but not limited to, edible materials like foodstuff F (carrots, celery, etc.) or other products regardless of whether it is prepackaged, which is seated within the second storage area. Said foodstuff F or other product can be protected from premature exposure by a second hermetic seal 840, possibly perforated, that opens (unzips, etc.) on three-sides using a common pull-strip or tape 842 while the bottom fourth side remains connected to the box 810, forming the clamshell-like closure 830, which facilitate pivoting of the closure 830 outward and downward (at P) to reveal the contents behind it. As can be seen in FIG. 47, the second storage area 822 is partially surrounded by the first storage area 818. For example, the second storage area 822 is adjacent the rear wall portion 831 and the bottom wall portion 824 forming the second storage area 822.

Figure 48:
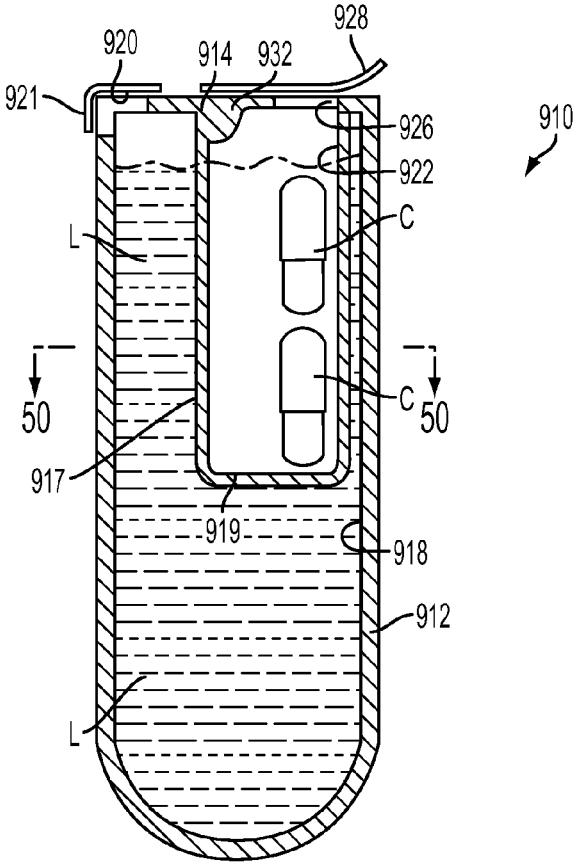
FIG. 48 is a cross-sectional elevational view of another storage vessel embodiment.
Figure 49:
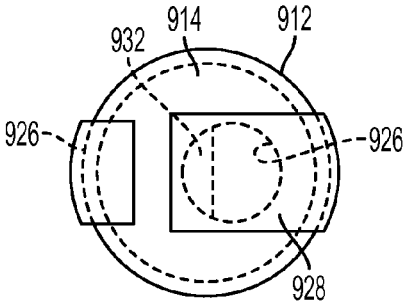
FIG. 49 is a top view of the storage vessel embodiment of FIG. 48.
Figure 50:
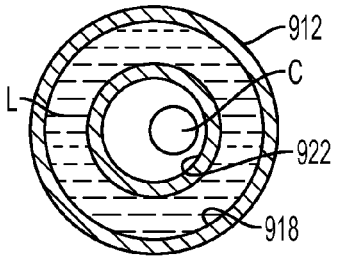
FIG. 50 is a cross-sectional view of the storage vessel embodiment of FIGS. 48 and 49 taken along line 50-50 in FIG. 48.

FIGS. 48-50 illustrate another combination storage vessel 910 that comprises a body 912 that may, in at least one form, be shaped to resemble a "test-tube" and be sized, for example, to conveniently fit in a person's pocket or purse. The body may be fabricated from a variety of suitable materials such as steel, aluminum, polymer, etc. and include a first storage area 918 that may surround, substantially surround or at least partially surround a second storage area 922. In the illustrated embodiment, for example, the vessel 910 has a top end wall 914 that is integral with or otherwise attached to the body 912. In various arrangements, the second storage area 922 is formed from an annular vertical wall 917 that protrudes from bottom side of the top end wall 914 and cooperates with an inner bottom wall 919. See FIG. 48. The vertical wall 917 may be located within the body 912 such that the second storage area 922 is surrounded by the first storage area 918.

A first access opening 920 is provided through the top end wall to provide access into the first storage area 918. The first access opening 920 may be hermetically sealed with a first peel-back seal 921. In other embodiments, for example, when the user desires to use a straw, the seal may comprise a puncturable membrane. A second access opening 926 may be provided through the top end wall 914 to provide access into the second storage area 922. The second access opening 926 may be hermetically sealed with a second peel-back seal 928. In other embodiments, a single peel-back or removable seal may be employed to simultaneously seal the first and second access openings. In other arrangements, the top end of the body may be formed with a threaded or twist-off, snap or otherwise removable cap that serves to cover both of the first and second access openings when attached to the body.

The storage vessel 910 is particularly-well-suited, for example, for storing/transporting medication or vitamin capsules/tablets with enough water or other liquid to facilitate swallowing of the capsules/tablets. As can be seen in FIG. 48, for example, two capsules "C" are contained within the second storage area 922 and a consumable liquid "L" is contained within the first storage area 918. To take or administer the capsules "C", the user simply removes the second peel-back seal 928 and inverts the vessel 910 to dump out the capsules C into the user's hand. The user then may peel back or otherwise remove or position the first seal 921 to expose the first access opening 920 and then drink the consumable liquid "L" through the opening 921 to assist in swallowing the capsules "C".

In various embodiments, an abutment formation 932 may be formed at the top of the vertical wall member 917 in an effort to prevent or at least retard the capsules "C" from spilling out when the vessel 910 is tilted back during consumption of the liquid L. See FIG. 48. The abutment 932 may protrude inwardly into the second storage area 922 from the vertical wall member 917 and may have a cross-sectional thickness that differs from the cross-sectional thickness of the vertical wall member 917 and/or the top end wall 914. For example, the abutment 932 may have a cross-sectional thickness that is greater than the cross-sectional thickness of the top end wall 914 to provide, for example, the abutment 932 with more rigidity to help retard inadvertent spillage of the contents within the second storage area 922 when the consumer tips the vessel to drink liquid from the first storage area 918. In addition, the abutment 932 may be advantageously provided with a curved or angled contour (when viewed in cross-section) to further facilitate inadvertent spillage from the second storage area 922 when the vessel is titled as described above. In still other embodiments, the abutment 932 may also have a shape (when, for example, it is viewed from above) that matches at least a portion of the contour of the second access opening 926.

In various embodiments, for example, the body 912 may be fabricated from transparent material to enable the user to determine the amount of material within the first and second storage areas. In various arrangements, the liquid "L" may comprise, for example, potable water. However, liquid "L" may comprise other consumable liquid materials such as, for example, cough medication, other liquid medications, juice, honey, sports drinks, etc. In addition, while the vessel 910 is particularly advantageous for facilitating the storage, transport and administration of medication, vitamins, etc. in the form of pills, capsules, tablets, etc., those of ordinary skill in the art will understand that the first and second storage areas may be use to store and administer consumable liquids. For example, different forms of liquid medication or other consumable liquids may be stored in the first and second storage areas.

Figure 51:
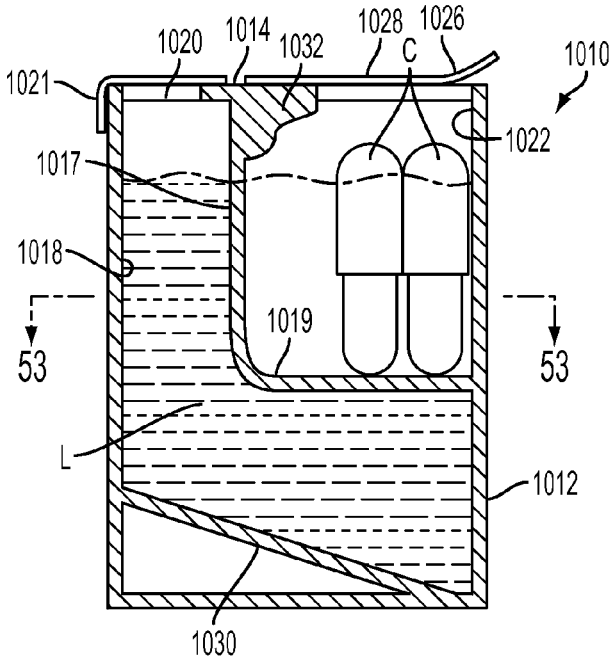
FIG. 51 is a cross-sectional elevational view of another storage vessel embodiment.
Figure 52:
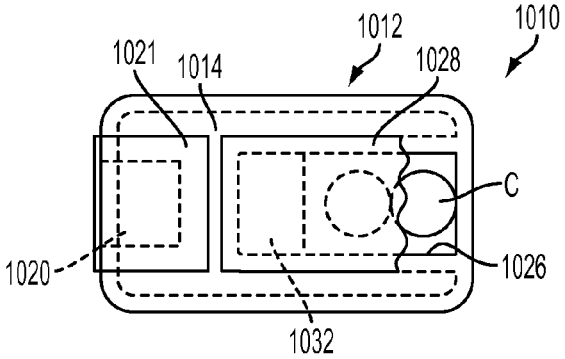
FIG. 52 is a top view of the storage vessel embodiment of FIG. 51.
Figure 53:
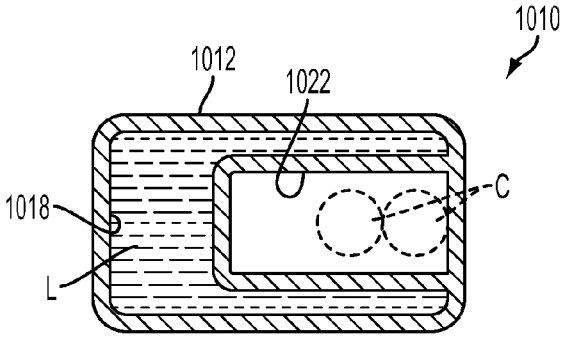
FIG. 53 is a cross-sectional view of the storage vessel embodiment of FIGS. 51 and 52 taken along line 53-53 in FIG. 51.

FIGS. 51-53 illustrate another combination storage vessel 1010 that comprises a body 1012 that may be shaped and sized, for example, to conveniently fit in a person's pocket or purse. The body 1012 may be fabricated from a variety of suitable materials such as steel, aluminum, polymer, etc. and include a first storage area 1018 that may surround, substantially surround or at least partially surround a second storage area 1022. In the illustrated embodiment, for example, the vessel 1010 has a top end wall 1014 that is integral with or otherwise attached to the body 1012. In various arrangements, the second storage area 1022 is formed from an annular vertical wall 1017 that protrudes from bottom side of the top end wall 1014 and cooperates with an inner bottom wall 1019. See FIG. 51. The vertical wall 1017 may be located within the body 1012 such that the second storage area 1022 is surrounded by the first storage area 1018.

A first access opening 1020 is provided through the top end wall 1014 to provide access into the first storage area 1018. The first access opening 1020 may be hermetically sealed with a first peel-back seal 1021. In other embodiments, for example, when the user desires to use a straw, the seal may comprise a puncturable membrane. A second access opening 1026 may be provided through the top end wall 1014 to provide access into the second storage area 1022. The second access opening 1026 may be hermetically sealed with a second peel-back seal 1028. In other embodiments, a single peel-back or removable seal may be employed to simultaneously seal the first and second access openings. In other arrangements, the top end of the body may be formed with a threaded or twist-off, snap or otherwise removable cap that serves to cover both of the first and second access openings when attached to the body.

The storage vessel 1010 is particularly-well-suited, for example, for storing/transporting medication or vitamin capsules/tablets with enough water or other liquid to facilitate swallowing of the capsules/tablets. As can be seen in FIG. 51, for example, two capsules "C" are contained within the second storage area 1022 and a consumable liquid "L" is contained within the first storage area 1018. To take or administer the capsules "C", the user simply removes the second peel-back seal 1028 and inverts the vessel 1010 to dump out the capsules C into the user's hand. The user then may peel back or otherwise remove or position the first seal 1021 to expose the first access opening 1020 and then drink the consumable liquid "L" through the opening 1021 to assist in swallowing the capsules "C".

In various embodiments, an abutment formation 1032 may be formed at the top of the vertical wall member 1017 in an effort to prevent or at least retard the capsules "C" from spilling out when the vessel 1010 is tilted back during consumption of the liquid L. See FIG. 51. The abutment 1032 may protrude inwardly into the second storage area 1022 from the vertical wall member 1017 and may have a cross-sectional thickness that differs from the cross-sectional thickness of the vertical wall member 1017 and/or the top end wall 1014. For example, the abutment 1032 may have a cross-sectional thickness that is greater than the cross-sectional thickness of the top end wall 1014 to provide, for example, the abutment 1032 with more rigidity to help retard inadvertent spillage of the contents within the second storage area 1022 when the consumer tips the vessel to drink liquid from the first storage area 1018. In addition, the abutment 1032 may be advantageously provided with a curved or angled contour (when viewed in cross-section) to further facilitate inadvertent spillage from the second storage area 1022 when the vessel is titled as described above. In still other embodiments, the abutment 1032 may also have a shape (when, for example, it is viewed from above) that matches at least a portion of the contour of the second access opening 1026. As can be seen in FIG. 51, the body 1012 may have an angled bottom surface 1030 that forms part of the first storage area 1018 that is intended to facilitate easier extraction of the water or other liquid by reducing the amount of backward/rearward tilt required for same.

In various embodiments, for example, the body 1012 may be fabricated from transparent material to enable the user to determine the amount of material within the first and second storage areas. In various arrangements, the liquid "L" may comprise, for example, potable water. However, liquid "L" may comprise other consumable liquid materials such as, for example, cough medication, other liquid medications, juice, honey, sports drinks, etc. In addition, while the vessel 1010 is particularly advantageous for facilitating the storage, transport and administration of medication, vitamins, etc. in the form of pills, capsules, tablets, etc., those of ordinary skill in the art will understand that the first and second storage areas may be use to store and administer consumable liquids. For example, different forms of liquid medication or other consumable liquids may be stored in the first and second storage areas.

Those of ordinary skill in the art will understand that the various embodiments disclosed herein and their respective equivalents may be advantageously employed in connection with a variety of different container or storage vessel arrangements. For example, various embodiments relate to an apparatus having pre-joined parts with pre-filled consumable liquids that can also separately contain a foodstuff or other product regardless of whether it is prepackaged. Various other embodiments may comprise a single-piece disposable, but not reusable, apparatus, which encompasses at least one integrally formed portion containing a pre-filled consumable liquid in a chamber or compartment separate from any other, none of which are separable.

Some embodiments resemble a conventional beverage can which can be dispensed from conventional beverage can dispensing machines known in the art. Other embodiments comprise box-shaped members that are readily hand-held to facilitate their portability and maneuverability when the consumer is in a tight or constrained space. Various other embodiments, however, may be shaped to resemble, for example, an animal, a cartoon character, a toy, a vehicle, or a variety of other inanimate or animate objects. Other embodiments are not hand-held. Thus, the protection afforded to the various embodiments and their respective equivalent structures should not be limited solely to those shapes or sizes depicted in the appended drawings.

Various embodiments comprise unique and novel combination beverage and foodstuff vessels or containers that may be used to contain a variety of different beverages and foodstuffs. While a number of different types of beverage and foodstuff examples have been mentioned herein, those of ordinary skill in the art will understand that the various embodiments may effectively support other types and forms of consumable liquids and foodstuffs without departing from the spirit and scope of the invention. In addition, in various embodiments, the foodstuffs may be replaced by non-edible objects, such as toys, novelty items, etc.

In various embodiments, the foodstuffs may be prepackaged in containers (e.g., polymer bags, etc.) prior to being placed into the second storage area. Such arrangement may facilitate manufacture of the foodstuffs at one location or by one manufacturer and then be shipped to another location wherein they are placed into the second storage area prior to being sent to the final distributor or consumer. In other embodiments, however, the foodstuffs, toys, novelty items, etc., may be directly placed into the second storage area by the manufacturer of the vessel. Likewise, in various embodiments, the consumable liquid is placed directly into the first storage area. In those embodiments, the first storage area comprises a hermetically-sealed chamber for storing the liquid while preventing the liquid from leaking out of the vessel prior to consumption. In other embodiments, however, the liquid may be "prepackaged" in a separate container that is placed into the first storage area. In such arrangements, for example, the consumable liquid may be prepackaged in a polymer bag that may be readily punctured by a sharpened end of a straw, etc. In such embodiments, it is conceivable that the first storage area/chamber may not be fluid-tight. In yet other embodiments, the combination vessel may comprise a collapsible member that has the first and second storage areas integrally formed therein.

Other forms of the present invention comprise a unique and novel manner for storing/transporting medications, vitamins, etc. In various forms, the storage vessel is sized and shaped to facilitate easy transport and manipulation. For example, the storage vessel may be sized and shaped to fit into one's pocket or purse and be easily carried in one hand. The vessel may include one hermetically sealed storage chamber that contains tablets, capsules, pills, etc. and another hermetically sealed chamber that contains potable water or other liquid for assisting the user in swallowing the tablets, capsules, pills, etc.

In accordance with at least one form, there is provided a combination beverage and storage vessel. The vessel may comprise a body that includes a non-removable top end wall and a bottom that serve to define an enclosed first storage area that is configured to support a consumable liquid therein. A second storage area may be integrally formed in the body and be configured to support at least one second item therein. A first access opening may be provided through a portion of at least one of the top end wall and the body into the first storage area. A first removable seal member may be attached to at least one of the top end wall and the body. The first removable seal may cover the first access opening to establish a first hermetical seal therewith. A second access opening may be provided through at least another portion of at least one of the body and top end wall into the second storage area. The second access opening may be larger than the first access opening.

In accordance with another form, there is provided a storage vessel/container that may include a body that has a non-removable top end wall and a bottom. The body may define an enclosed first storage area. A first access opening may extend through at least one of the top end wall and the body into the first storage area. Potable water may be provided within the enclosed first storage area. A second storage area may extend into the first storage area such that the first storage area at least partially surrounds the second storage area. A second access opening may be provided through at least one of the top end wall and the body portion into the second storage area. The second storage area may have at least one consumable pill, tablet or capsule therein. Sealing means may be removably coupled to the body for sealing the first and second access openings.

In accordance with yet another form, there is provided a combination beverage cup and storage vessel. The vessel may include a cup body that defines a first storage area that contains a consumable liquid therein. A lid may be non-removably attached to the cup body and include a recessed cavity that is integrally-formed therein. The vessel may further include a second storage container that is sized to be received within the recessed cavity and configured to store at least one second item therein.

In accordance with at least one form, there is provided a combination beverage container and storage vessel having a primary outer chamber with a narrower inner diameter intended to hold a pre-filled hermetically sealed consumable liquid, such as juice or milk, removable by spout or straw, which incorporates a second smaller chamber that can hold a variety of products regardless of whether edible or sealed, or configured to accept insertion of a separate container with or without snap-in features to retain same within said separate container.

In accordance with at least one other general form, there is provided a combination beverage and storage vessel that includes a body portion that includes a non-removable top end portion and a bottom portion and defines a first storage area that is configured to support a consumable liquid therein. A first access opening is provided through the top end portion into the first storage area. A first seal member covers the first access opening to establish a first hermetically seal therewith. A second storage area is integrally formed in the body portion and is configured to support at least one second item therein. A second access opening is provided through the body portion into the second storage area.

In accordance with still another general aspect, there is provided a combination beverage and storage vessel. In at least one form, the vessel includes a body portion that includes a non-removable top end portion and a bottom portion and defines an enclosed first storage that has a first storage volume and is configured to support a consumable liquid therein. A first access opening extends through the top end portion into the first storage area. A first seal member covers the first access opening to establish a first hermetically seal therewith. A second storage area is integrally formed in the body portion and includes a second storage volume is configured to support at least one second item therein. The first storage volume is greater than the second storage volume and a second access opening through the body portion into the second storage area. In alternative embodiments, the second storage volume is greater than the first storage volume.

In accordance with still another general aspect, there is provided a combination beverage and storage vessel. In at least one form, the vessel includes a body portion that includes a non-removable top end portion and a bottom portion and defines an enclosed first substantially fluid-tight storage area. A first access opening is provided through the body portion into the first storage area. A first seal member covers the first access opening to establish a first hermetically seal therewith. A consumable liquid is stored in the first substantially fluid-tight storage area. A second storage area is integrally formed in the body portion. A second access opening is provided through the body portion into the second storage area. A second removable seal member covers the second access opening to establish a second hermetic seal therewith. At least one second item is supported in the second storage area.

In accordance with another general aspect, there is provided a combination beverage and storage vessel. In at least one form, the vessel comprises a body portion that includes a non-removable top end portion and a bottom portion that defines a first storage area that is configured to support a consumable liquid therein. A first access opening is provided through the body portion into the first storage area. A first seal member covers the first access opening to establish a first hermetically seal therewith. A cavity is provided within the hand-held body portion. A second storage container is removably retained within the cavity and configured to support at least one second item therein. A second access opening is provided in the second storage container.

In accordance with another general aspect, there is provided a combination beverage and storage vessel. In at least one embodiment, the vessel comprises a cup body that defines a first storage area. A consumable liquid is supported in the first storage area. A lid is non-removably attached to the cup body. The lid has an integrally-formed recessed cavity therein. A second storage container is sized to be received within the recessed cavity. At least one second item is stored in the second storage container.

While the embodiments have been described as having exemplary designs, each of the various embodiments and arrangements may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A combination beverage and food container, comprising:

a container body including sides, a top end wall and a bottom, one of said sides comprising a substantially triangular-shaped, open ended cavity that is configured to support at least one food item therein;

a removable first seal attached to the container body to enclose the open ended cavity;

an enclosed fluid-tight storage area adjacent the cavity within the container body; and a first sealable access opening into the enclosed fluid-tight storage area through said top end wall such that the fluid-tight storage area is accessible through the first sealable access opening without removing the removable first seal and without moving the open ended cavity relative to the container body.

2. The combination beverage and food container of claim 1 wherein the enclosed fluid-tight storage area shares at least one common wall with the cavity.

3. The combination beverage and food container of claim 2 wherein the cavity and the enclosed fluid-tight storage area are integrally formed in the container body.

4. The combination beverage and food container of claim 1 wherein the enclosed fluid-tight storage area at least partially surrounds the cavity.

5. The combination beverage and food container of claim 4 wherein the enclosed fluid-tight storage area is adjacent to at least two sides of the cavity.

6. The combination beverage and food container of claim 4 wherein the enclosed fluid-tight storage area is adjacent to four sides of the cavity.

7. The combination beverage and food container of claim 1 wherein the first sealable access opening extends through a top end wall of the container body.

8. The combination beverage and food container of claim 1 wherein the enclosed fluid-tight storage area is formed in a separate container that is attached to the container body.

9. The combination beverage and food container of claim 2 wherein the first sealable access opening is defined by a spout that protrudes outwardly from the top end wall of the container body, the top end wall being positioned at an acute angle relative to the common wall.

10. The combination beverage and sandwich container of claim 1 wherein the enclosed fluid-tight storage area is oriented relative to the open ended cavity such that the enclosed fluid-tight storage area and said open ended cavity are adjacent and external to each other.

11. The combination beverage and food container of claim 1 wherein said container body is fabricated from transparent material.

12. A combination beverage and food container, comprising:

a container body defining a substantially triangular-shaped, open ended cavity that includes a cavity bottom and is configured to support at least one food item therein;

a removable first seal attached to the container body to enclose the open ended cavity;

an enclosed L-shaped fluid-tight storage area adjacent the cavity within the container body such that a portion of said enclosed fluid-tight cavity extends under said cavity bottom and is coextensive therewith; and a first sealable access opening into the enclosed fluid-tight storage area such that the fluid-tight storage area is accessible through the first sealable access opening without removing the removable first seal and without moving the open ended cavity relative to the container body.

13. The combination beverage and food container of claim 1 further comprising at least one sandwich wedge within the cavity.

14. The combination beverage and food container of claim 1 further comprising a consumable liquid within the enclosed fluid-tight storage area.

* * * * *